US008807701B2

(12) United States Patent
Shinoda

(10) Patent No.: US 8,807,701 B2
(45) Date of Patent: Aug. 19, 2014

(54) LIQUID EJECTION APPARATUS

(75) Inventor: Akira Shinoda, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 29 days.

(21) Appl. No.: 13/433,047

(22) Filed: Mar. 28, 2012

(65) Prior Publication Data

US 2013/0002751 A1 Jan. 3, 2013

(30) Foreign Application Priority Data

Jun. 30, 2011 (JP) ..... 2011-145441

(51) Int. Cl.
*B41J 2/165* (2006.01)

(52) U.S. Cl.
CPC ..... *B41J 2/165* (2013.01); *B41J 2/16532* (2013.01); *B41J 2/16505* (2013.01)
USPC ..... 347/29

(58) Field of Classification Search
CPC ..... B41J 2/165; B41J 2002/16555; B41J 2/16532; B41J 2/16505
USPC ..... 347/6, 29, 31, 33
See application file for complete search history.

(56) References Cited

U.S. PATENT DOCUMENTS

| | | | | |
|---|---|---|---|---|
| 4,223,324 | A | 9/1980 | Yamamori et al. | |
| 6,183,058 | B1 | 2/2001 | Sharma et al. | |
| 7,328,960 | B2 | 2/2008 | Sakagami et al. | |
| 2005/0168517 | A1 | 8/2005 | Usuda | |
| 2005/0190215 | A1* | 9/2005 | Morikoshi | 347/6 |
| 2007/0146407 | A1 | 6/2007 | Hiraoka | |
| 2008/0030504 | A1 | 2/2008 | Brunner et al. | |
| 2009/0033707 | A1 | 2/2009 | Shimazaki | |
| 2009/0109257 | A1 | 4/2009 | Shimazaki | |
| 2009/0195593 | A1 | 8/2009 | Iwanaga | |

(Continued)

FOREIGN PATENT DOCUMENTS

| | | |
|---|---|---|
| CN | 1647925 A | 8/2005 |
| JP | H03-184852 A | 8/1991 |

(Continued)

OTHER PUBLICATIONS

European Patent Office, extended European Search Report for European Patent Application No. 12152831.9 (counterpart European Patent Application), dated Jun. 14, 2012.

(Continued)

*Primary Examiner* — An Do
(74) *Attorney, Agent, or Firm* — Baker Botts L.L.P.

(57) ABSTRACT

A liquid ejection apparatus, including: a liquid ejection head having an ejection face; a sealing mechanism configured to selectively establish a sealing state in which an ejection space is sealed and an unsealing state; first and second openings, interposing at least a part of the ejection face in one direction, for supplying air into the ejection space; a generating portion configured to generate humid air; a supply portion configured to supply the generated humid air into the ejection space via the first or the second opening; and a controller configured to control the supply portion such that a period in which the humid air is supplied via the first opening and a period in which the humid air is supplied via the second opening do not overlap each other when the humid air is supplied into the ejection space in a current humid-air supply processing.

11 Claims, 12 Drawing Sheets

(56) References Cited

U.S. PATENT DOCUMENTS

| | | | |
|---|---|---|---|
| 2010/0171789 | A1 | 7/2010 | Mun et al. |
| 2012/0194584 | A1 | 8/2012 | Tamaki |
| 2012/0194605 | A1 | 8/2012 | Tamaki et al. |

FOREIGN PATENT DOCUMENTS

| | | | |
|---|---|---|---|
| JP | 2003-334962 | A | 11/2003 |
| JP | 2005-212138 | A | 8/2005 |
| JP | 2006-159717 | A | 6/2006 |
| JP | 2009-034912 | A | 2/2009 |
| JP | 2009-184132 | A | 8/2009 |
| JP | 2009-285982 | A | 12/2009 |
| JP | 2011-101956 | A | 5/2011 |

OTHER PUBLICATIONS

European Patent Office, Extended European Search Report for European Patent Application No. 12161636.1 (counterpart European Patent Application), mailed Sep. 10, 2013.

State Intellectual Property Office of the People'S Republic of China, Notification of the First Office Action for Chinese Patent Application No. 201210082366.9 (counterpart to above-captioned patent application), mailed Mar. 10, 2014.

* cited by examiner

LIQUID EJECTION APPARATUS

CROSS REFERENCE TO RELATED APPLICATION

The present application claims priority from Japanese Patent Application No. 2011-145441, which was filed on Jun. 30, 2011, the disclosure of which is herein incorporated by reference in its entirety.

BACKGROUND OF THE INVENTION

1. Field of the Invention

The present invention relates to a liquid ejection apparatus configured to eject liquid from ejection openings.

2. Description of the Related Art

A liquid ejection apparatus includes a head having an ejection face opening therein through which liquid such as ink is ejected. If the liquid has not been ejected from the ejection openings for a long time, water components contained in the liquid near the ejection openings vaporize, and a viscosity of the ink increases, resulting in clogging of the ejection openings. The following technique is known as a technique for preventing the clogging of the ejection openings. In this technique, a recessed capping member covers an ejection face to form an ejection space isolated from an outside space. An air-conditioning device has air channels having an air-supply opening and an air-discharge opening formed in a bottom face of the capping member. This air-conditioning device supplies humidified air (air having a high humidity) from the air-supply opening into the ejection space and discharges air in the ejection space from the air-discharge opening to suppress the vaporization of the water components contained in the liquid near the ejection openings.

In reality, there is a difference in a humidity between the humidified air supplied into the ejection space and the liquid in the ejection openings (that is, water components are transferred between the air and the liquid). There is a case where a user wants to resolve the clogging of the ejection openings by supplying water components of the humidified air supplied into the ejection space, to thickened liquid near the ejection openings.

SUMMARY OF THE INVENTION

If the above-described technique is utilized in this case, when the humidified air is supplied into the ejection space, a humidity near the air-supply opening becomes a desired humidity for a relatively short time, but the entire ejection space needs to be uniformly humidified to make a humidity near the air-discharge opening become the desired humidity. That is, the ejection openings near the air-supply opening are easily humidified sufficiently, but it is difficult to sufficiently humidify the ejection openings near the air-discharge opening. Thus, in order to make all the ejection openings a high humidity, there is a need to make the entire ejection space a high humidity uniformly, but this requires a relatively long time.

This invention has been developed to provide a liquid ejection apparatus capable of making uniform a humidity of an ejection space defined so as to face an ejection face for a relatively short time.

This invention has been developed to provide a liquid ejection apparatus, including: a liquid ejection head having an ejection face that has a plurality of ejection openings through which the liquid ejection head ejects liquid, an ejection space being defined so as to face the ejection face; a sealing mechanism configured to selectively establish (i) a sealing state in which the sealing mechanism seals the ejection space from an outside space and (ii) an unsealing state in which the sealing mechanism does not seal the ejection space from the outside space; a first opening and a second opening formed respectively at positions interposing at least a part of the ejection face therebetween in one direction, the first opening and the second opening each being for supplying air into the ejection space therethrough; a generating portion configured to generate humid air; a supply portion configured to supply the humid air generated by the generating portion into the ejection space in the sealing state via one of the first opening and the second opening; and a controller configured to control the supply portion such that a period in which the humid air is supplied via the first opening and a period in which the humid air is supplied via the second opening do not overlap each other in a current humid-air supply processing.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Figure 1:
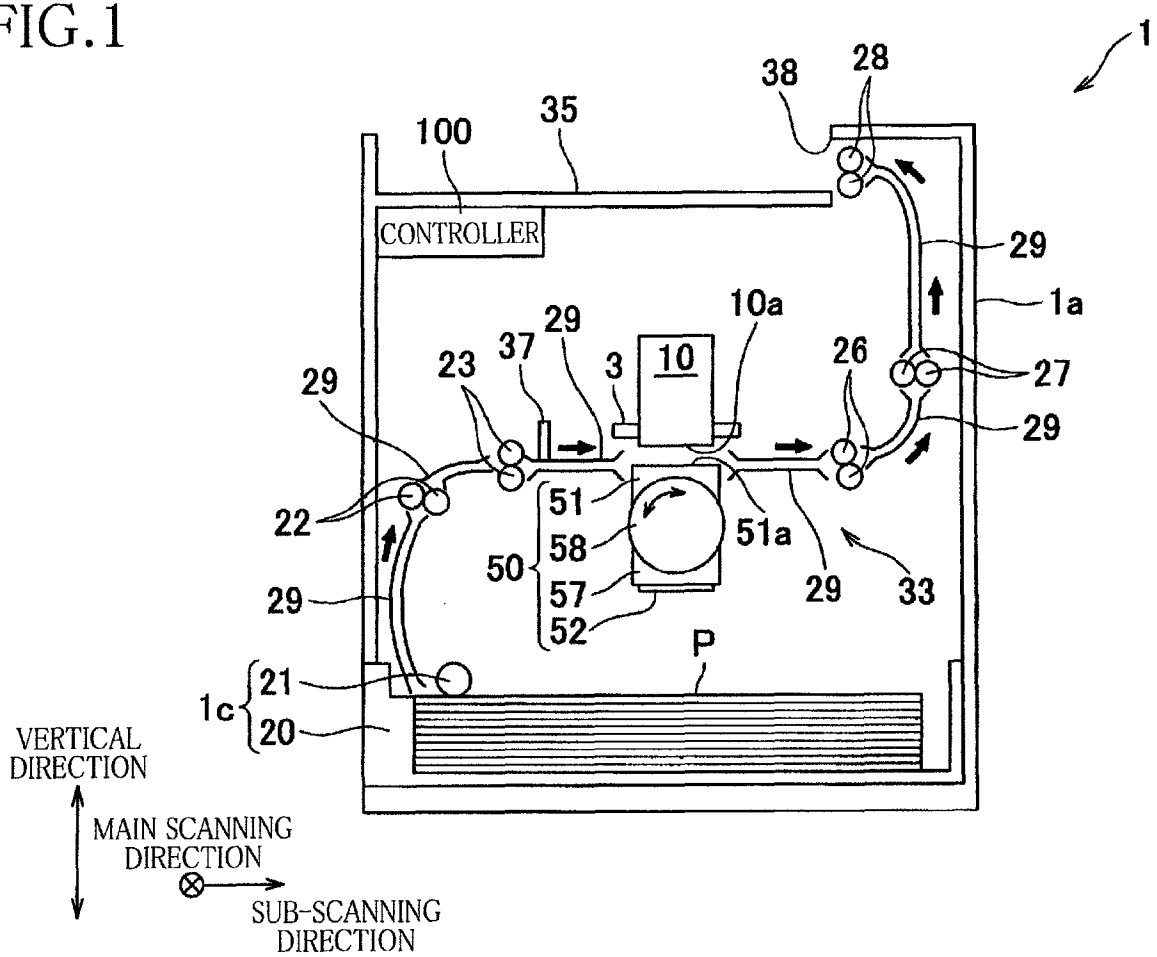
FIG. 1 is a side view generally showing an overall construction of an ink-jet printer as one embodiment to which the present invention is applied.

Hereinafter, there will be described one embodiment to which the present invention is applied, by reference to the drawings.

First, there will be explained an overall construction of a liquid ejection apparatus in the form of an ink-jet printer 1 as one embodiment of the present invention with reference to FIG. 1.

The printer 1 includes a casing 1*a* having a rectangular parallelepiped shape. A sheet-discharge portion 35 is provided on a top plate of the casing 1*a*. In a space defined by the casing 1*a*, there is formed a sheet conveyance path through which a sheet P (as one example of a recording medium) is conveyed from a sheet-supply unit 1*c* which will be described below toward the sheet-discharge portion 35 along bold arrows in FIG. 1.

The casing 1*a* accommodates (a) a liquid ejection head in the form of a head 10, (b) a conveyance mechanism 33 configured to convey the sheet P through a position facing or just under an ejection face 10*a* of the head 10, (c) a support-cap unit 50 corresponding to the head 10, (d) a humidification unit 60 (see FIG. 5) used for a humidifying maintenance, (e) a cartridge, not shown, storing black ink to be supplied to the head 10, (f) a controller 100 for controlling operations of components of the printer 1, and so on.

The head 10 is a line head having a generally rectangular parallelepiped shape elongated in a main scanning direction. A lower face of the head 10 is the ejection face 10*a* having a multiplicity of ejection openings 14*a* (see FIGS. 3 and 4) opened therein. In image recording (image forming), the head 10 ejects the black ink from the ejection openings 14*a*. The head 10 is supported by the casing 1*a* via a head holder 3. The head holder 3 supports the head 10 such that the ejection face 10*a* faces a support face 51*a* which will be described below with a specific space therebetween appropriate for the image recording. A structure of the head 10 will be explained later in detail.

In a recording mode in which the ink is ejected from the ejection openings 14*a* onto the sheet P, the controller 100 controls a conveyance operation of the components of the printer 1 for conveying the sheet P and an ink ejecting operation synchronized with the conveyance operation of the sheet P on the basis of recording data (as one example of a liquid ejection signal) transmitted from an external device. In a maintenance for maintaining the ejection face 10*a*, the controller 100 controls a maintenance operation for recovering or maintaining an ejection characteristic.

The maintenance operation includes flushing, purging, wiping, the humidifying maintenance, and so on. The flushing is an operation for forcing the ink to be ejected from ejection opening(s) 14*a* by driving actuators of the head 10 on the basis of flushing data that is different from image data. The purging is an operation for forcing the ink to be ejected from all of the ejection openings 14*a* by applying a pressure to the ink in the head 10 by a purging mechanism 8 (see FIG. 7). The wiping is an operation for wiping foreign matters (e.g., the ink) on the ejection face 10*a* by a wiper 9 (see FIG. 7). The humidifying maintenance is an operation for supplying humid air into ejection space V1 (see FIGS. 5 and 6) defined and sealed by the ejection face 10*a* of the head 10 and a recessed member 52 which will be described below. The purging and the flushing (hereinafter collectively called a forced ejection maintenance) are performed where the ink is not ejected from the ejection openings 14*a* for a predetermined length of time (noted that this predetermined length of time may be set to be longer in the purging than in the flushing). In the purging and the flushing, the ink whose viscosity has increased in the ejection openings 14*a*, and air bubbles and dust particles in the ejection openings 14*a* are discharged with the ink from the ejection openings 14*a*. The humidifying maintenance will be explained in detail. It is noted that the purging mechanism 8 may include a pump for forcing the ink to be transferred from the cartridge to the head 10, for example.

The conveyance mechanism 33 includes the sheet-supply unit 1*c*, a guide 29, conveyance-roller pairs 22, 26-28, and a register roller pair 23 and constitutes the sheet conveyance path extending from the sheet-supply unit 1*c* to the sheet-discharge portion 35. The sheet-supply unit 1*c*, the conveyance-roller pairs 22, 26-28, and the register roller pair 23 are controlled by the controller 100.

The sheet-supply unit 1*c* includes a sheet-supply tray 20 and a sheet-supply roller 21. The sheet-supply tray 20 can be mounted on and removed from the casing 1*a* in a sub-scanning direction. The sheet-supply tray 20 has a box-like shape opening upward and can accommodate sheets P. The sheet-supply roller 21 is rotated by control of the controller 100 to supply an uppermost one of the sheets P in the sheet-supply tray 20.

The sheet P supplied by the sheet-supply roller 21 is conveyed to the register roller pair 23 while being guided by the guide 29 and nipped by the conveyance roller pair 22. The register roller pair 23 nips a leading end of the sheet P conveyed by the conveyance roller pair 22 for a predetermined registering time in a state in which the register roller pair 23 is not rotated. As a result, an inclination (oblique conveyance) of the sheet P is corrected in the state in which the leading end of the sheet P is nipped by the register roller pair 23. After the registering time has passed, the register roller pair 23 is rotated to convey the sheet P whose inclination has been corrected, to the position between the head 10 and the support-cap unit 50.

Here, the sub-scanning direction is a direction parallel to a conveyance direction in which the sheet P is conveyed by the register roller pair 23, and the main scanning direction is a direction parallel to a horizontal plane and perpendicular to the sub-scanning direction.

When the sheet P has been conveyed to the position between the head 10 and the support-cap unit 50 by the register roller pair 23 and passes through the position just under the head 10 in the sub-scanning direction, the ink is ejected from the ejection openings 14*a*, whereby a monochrome image is formed on the sheet P. The ink ejecting operation from the ejection openings 14*a* is controlled by the controller 100 on the basis of a detection signal outputted from a sheet sensor 37. The sheet P is then conveyed upward by the conveyance-roller pairs 26-28 while being guided by the guide 29. The sheet P is finally discharged onto the sheet-discharge portion 35 through an opening 38 formed in an upper portion of the casing 1*a*.

Figure 2:
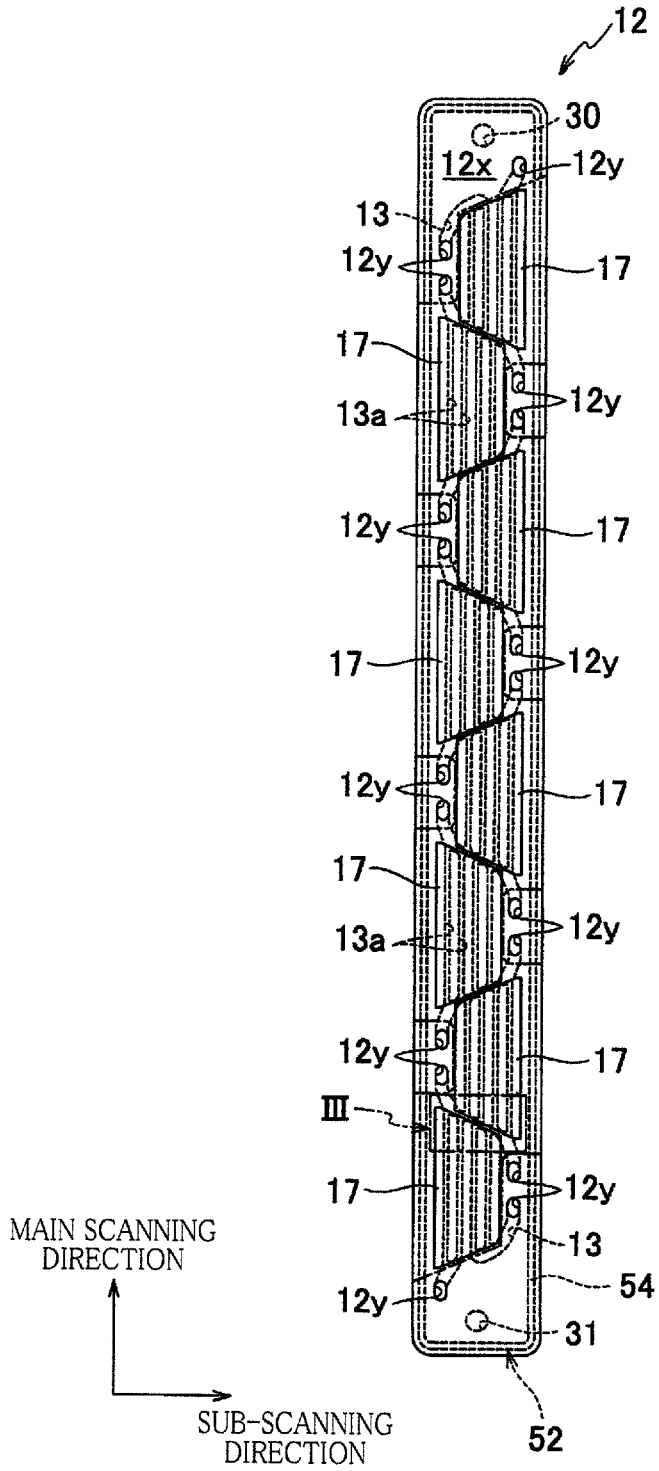
FIG. 2 is a plan view showing a channel unit, actuator units, and a recessed member of a head in FIG. 1.
Figure 3:
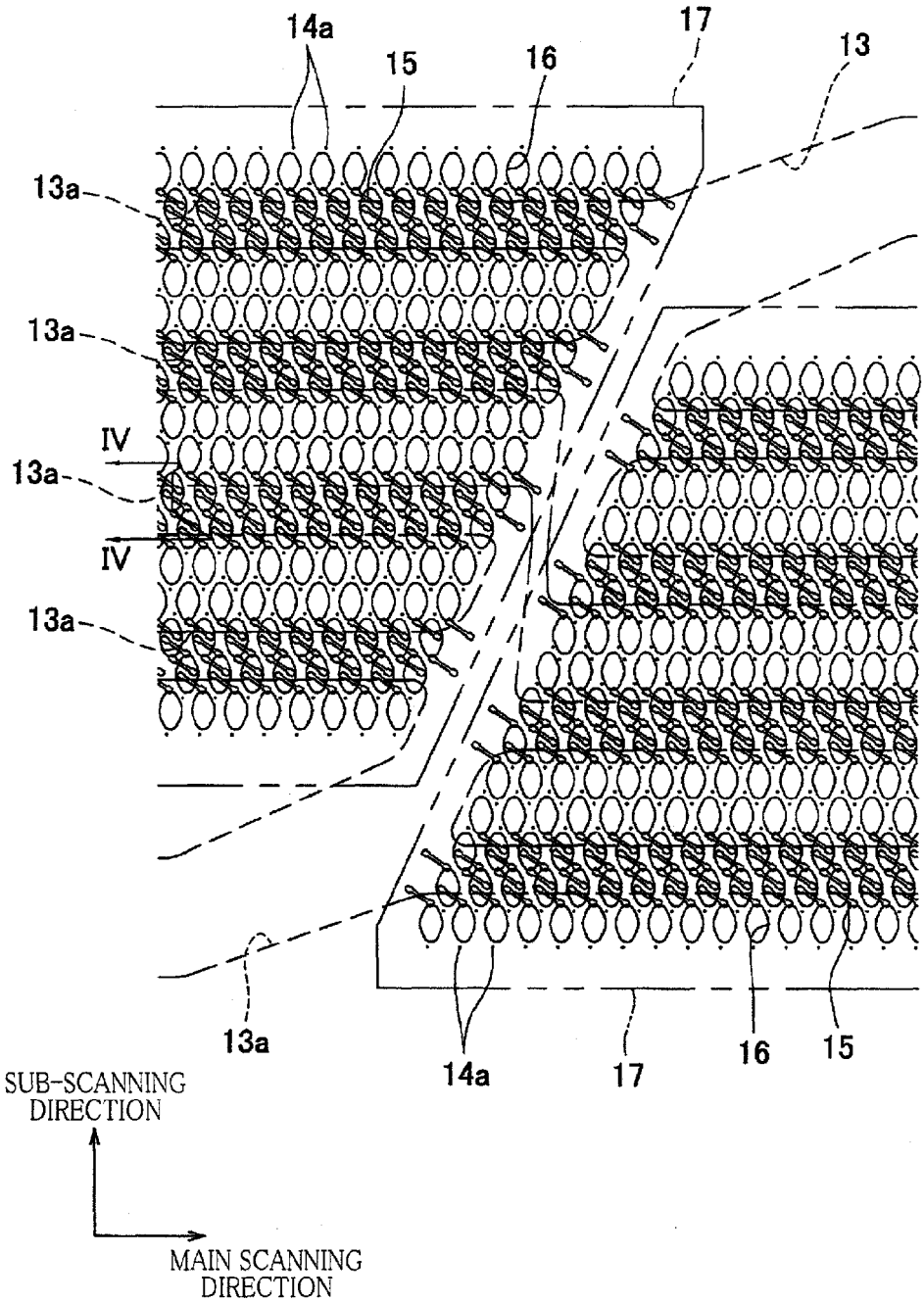
FIG. 3 is an enlarged view showing an area III enclosed by one-dot chain line in FIG. 2.
Figure 4:
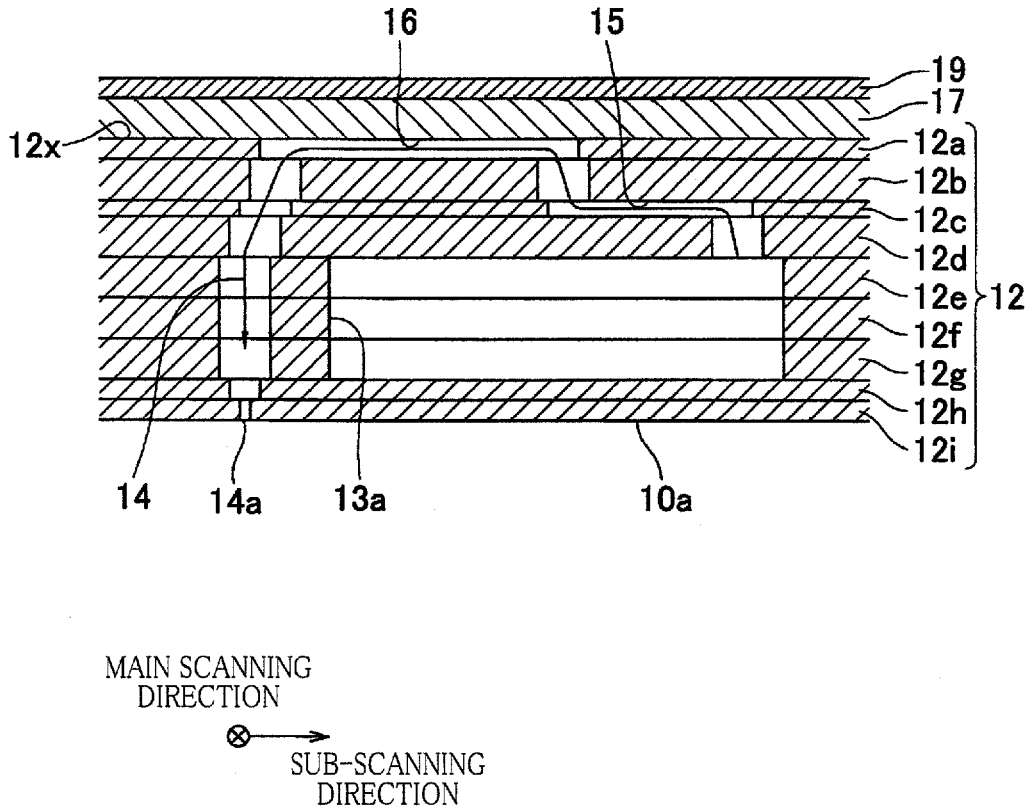
FIG. 4 is a partial cross-sectional view taken along line IV-IV in FIG. 3.

There will be next explained the structure of the head 10 with reference to FIGS. 2-4. It is noted that, in FIG. 3, pressure chambers 16 and apertures 15 are illustrated by solid lines for easier understanding purposes though these elements are located under actuator units 17 and thus should be illustrated by broken lines.

The head 10 includes a reservoir unit 11 (see FIG. 5), a channel unit 12 (see FIG. 4), the eight actuator units 17 (see FIG. 2) fixed to an upper face 12*x* of the channel unit 12, a Flexible Printed Circuit (FPC) 19 (see FIG. 4) bonded to each of the actuator units 17 and so on which are stacked on one another in a vertical direction. In the reservoir unit 11 are formed ink channels including a reservoir that temporarily stores the ink supplied from the cartridge. In the channel unit 12 are formed ink channels each extending from a corresponding one of openings 12*y* of the upper face 12*x* (see FIG. 2) to a corresponding one of the ejection openings 14*a* formed in a lower face of the channel unit 12 (i.e., the ejection face 10*a*). The actuator units 17 include piezoelectric actuators for the respective ejection openings 14*a*.

Protruding portions and recessed portions are formed on and in a lower face of the reservoir unit 11. The protruding portions are bonded to the upper face 12*x* of the channel unit 12 at areas on which no actuator units 17 are disposed (noted that the areas include the openings 12*y* and are enclosed with two-dot chain lines in FIG. 2). A distal end face of each of the protruding portions has an opening connected to the reservoir and facing a corresponding one of the openings 12*y* of the channel unit 12. As a result, the reservoir and the ink channels of the channel unit 12 are communicated with each other via the above-described openings. The recessed portions face the upper face 12*x* of the channel unit 12, faces of the respective actuator units 17, and a face of the FPC 19 with slight spaces formed therebetween.

The channel unit 12 is a stacked body constituted by nine metal rectangular plates 12*a*-12*i* (see FIG. 4) having generally the same size and bonded to one another. As shown in FIGS. 2-4, the ink channels of the channel unit 12 include: manifold channels 13 each having a corresponding one of the openings 12*y* as one end; sub-manifold channels 13*a* each branched from a corresponding one of the manifold channels 13; and the individual ink channels 14 respectively extending from outlets of the sub-manifold channels 13*a* to the ejection openings 14*a* via the pressure chambers 16. As shown in FIG. 4, the individual ink channel 14 is formed for each ejection opening 14*a* so as to have the aperture 15 functioning as a restrictor for adjusting a channel resistance. Generally rhombic openings for respectively exposing the pressure chambers 16 are formed in matrix in areas on the upper face 12*x* to which the actuator units 17 are respectively bonded. The ejection openings 14*a* are formed in matrix in the same pattern as the pressure chambers 16, in the lower face (i.e., the ejection face 10*a*) at areas opposed to the areas on the upper face 12*x* to which the actuator units 17 are respectively bonded. Specifically, as shown in FIG. 3, in each area are formed sixteen ejection-opening rows each including a plurality of ejection openings 14*a* arranged in the main scanning direction.

As shown in FIG. 2, the actuator units 17 each having a trapezoid shape are arranged on the upper face 12*x* in a staggered configuration. As shown in FIG. 3, each of the actuator units 17 covers the multiplicity of the pressure chambers 16 formed under the actuator unit 17. Though not shown, each of the actuator units 17 includes: a plurality of piezoelectric layers expanding over the multiplicity of the pressure chambers 16; and electrodes interposing the piezoelectric layers in a thickness direction of the actuator units 17. The electrodes include: a common electrode common for the pressure chambers 16 and individual electrodes provided for the respective pressure chambers 16. The individual electrodes are formed on a face of an uppermost one of the piezoelectric layers.

The FPC 19 has wirings corresponding to the respective electrodes of the actuator units 17, and a driver IC, not shown, is mounted on the wirings. The FPC 19 is fixed at one end thereof to the actuator units 17 and at the other end to a control board, not shown, of the head 10, which is disposed on an upper side of the reservoir unit 11. The FPC 19 sends the driver IC various drive signals outputted from the control board and sends the actuator units 17 signals produced by the driver IC.

Figure 5:
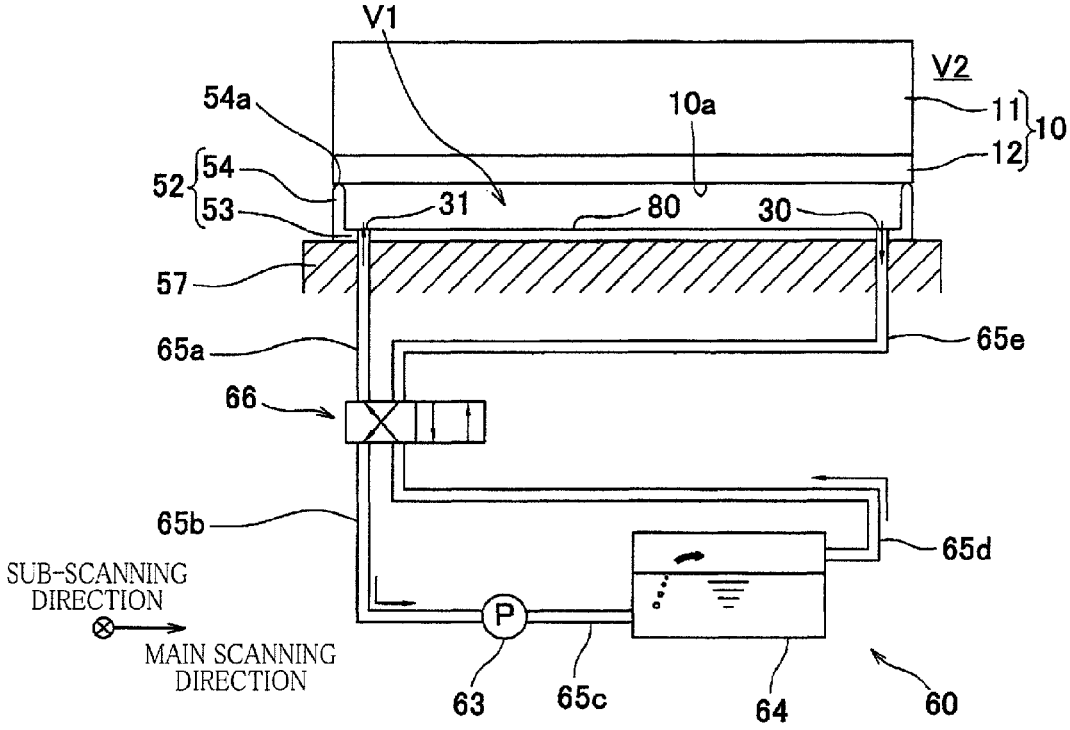
FIG. 5 is a schematic view showing the head and the recessed member in FIG. 1 and a humidification unit.

There will be next explained the support-cap unit 50 with reference to FIGS. 1, 2, and 5.

As shown in FIG. 1, the support-cap unit 50 is disposed so as to face the ejection face 10*a* of the head 10 in the vertical direction. The support-cap unit 50 includes: a rotor 58 having a shaft extending in the main scanning direction and rotatable about the shaft by the control of the controller 100; a platen 51 and a cap fixation member 57 fixed to an outer circumferential face of the rotor 58; the recessed member 52 fixed to the cap fixation member 57; and a rotor raising and lowering mechanism 56 (see FIG. 7) configured to move the rotor 58 upward or downward in the vertical direction.

The platen 51 is one size larger than the ejection face 10*a* in the main scanning direction and the sub-scanning direction and disposed so as to be opposed to the cap fixation member 57 in the vertical direction. A face of the platen 51 is the support face 51*a* for supporting the sheet P while facing the ejection face 10*a*. A material and a processing for the support face 51*a* are employed so as to reliably hold the sheet P. For example, a silicon layer having a low viscosity is formed on the support face 51*a*, and a multiplicity of ribs are formed on the support face 51*a* in the sub-scanning direction, preventing floating and the like of the sheet P placed on the support face 51*a*. The platen 51 is formed of a resin material.

The rotor 58 is controlled by the controller 100 to be rotated so as to selectively take or establish (i) a first rotation state (see FIG. 1) in which the support face 51*a* faces the ejection face 10*a* while a facing face 80 (see FIG. 5) which will be described below does not face the ejection face 10*a* and (ii) a second rotation state (see FIG. 5) in which the support face 51*a* does not face the ejection face 10*a* while the facing face 80 faces the ejection face 10*a*. When the rotor 58 being in the first rotation state is rotated 180 degrees, the rotor 58 takes the second rotation state. In the present embodiment, the controller 100 controls the rotor 58 to take the first rotation state in the recording mode and in a recording waiting mode for waiting arrival of the recording data and to take the second rotation state in a maintenance mode for the maintenance operation.

The rotor raising and lowering mechanism 56 supports the shaft of the rotor 58 and moves the rotor 58 upward or downward in the vertical direction by the control of the controller 100. This upward or downward movement of the rotor 58 moves the recessed member 52 fixed to the rotor 58 via the cap fixation member 57, thereby changing a vertical position of the recessed member 52 relative to the ejection face 10*a*. It is noted that a rack and a pinion, or a solenoid may be used as the rotor raising and lowering mechanism 56, for example.

As shown in FIG. 5, the recessed member 52 is fixed to the cap fixation member 57 and constituted by (i) a facing member 53 that faces the ejection face 10*a* and (ii) an annular member 54 provided upright on a peripheral portion of the facing member 53. The facing member 53 and the annular member 54 are formed integrally with each other. The annular member 54 is formed of an elastic material such as rubber, and as shown in FIG. 2, faces a peripheral portion of the ejection face 10*a* in plan view. That is, the annular member 54 is formed to have an annular shape such that all the actuator units 17 and all the ejection openings 14*a* are surrounded by the annular member 54 in plan view.

Figure 6:
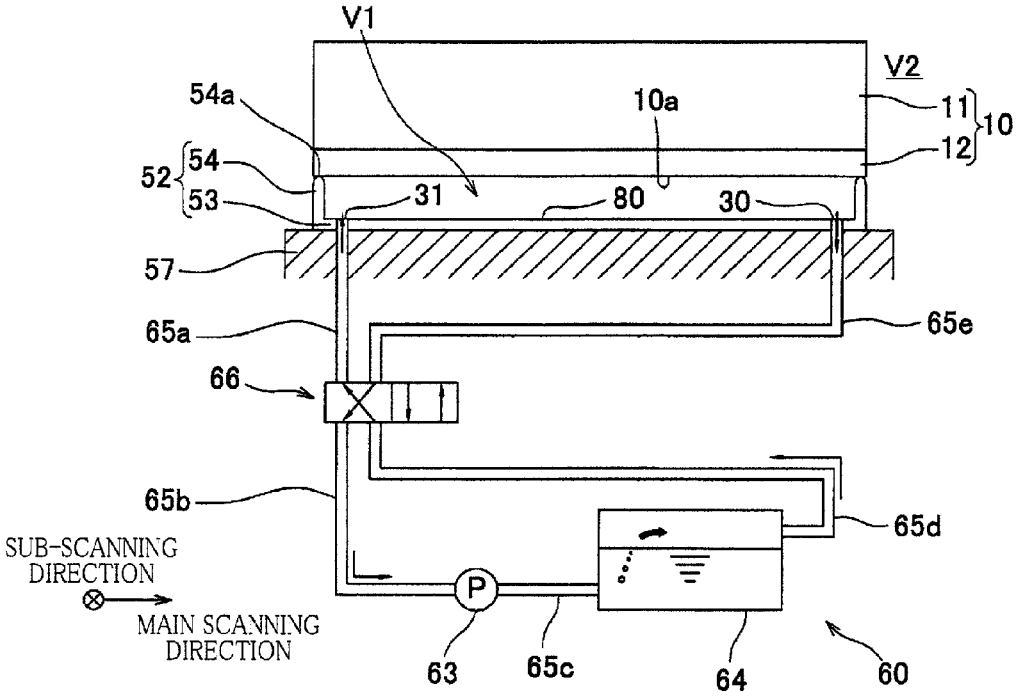
FIG. 6 is a schematic view showing the head and the recessed member in FIG. 1 and the humidification unit.

In the state in which the facing face 80 faces the ejection face 10*a*, the upward or downward movement of the rotor 58 by the rotor raising and lowering mechanism 56 moves the recessed member 52 selectively to (i) a contact position (see FIG. 5) at which a distal end 54*a* of the annular member 54 contacts with the ejection face 10*a* and (ii) a distant position at which the distal end 54*a* of the annular member 54 is distant from the ejection face 10*a* of the head 10. As shown in FIGS. 5 and 6, when the recessed member 52 is located at the contact position, the ejection space V1 under (facing) the ejection face 10*a* is sealed by the recessed member 52 and the ejection face 10*a* so as to be isolated from an outside space V2.

It is noted that, when the recessed member 52 is located at the distant position, the ejection space V1 under the ejection face 10*a* is not sealed or isolated from the outside space V2. In the present embodiment, the recessed member 52, the rotor raising and lowering mechanism 56, and the controller 100 function as a cap unit that is moved to selectively take (i) a sealing state for sealing or isolating the ejection space V1 from the outside space V2 (i.e., the state in which the recessed member 52 is located at the contact position) and (ii) an unsealing (open) state in which the ejection space V1 is not sealed or isolated from the outside space V2 (i.e., the state in which the recessed member 52 is located at the distant position). In the present embodiment, the cap unit can take the sealing state or the unsealing state only by the movement of the recessed member 52, that is, the cap unit has a simple structure.

The facing member 53 is formed of a material such as a glass or a metal (e.g., SUS) having a property of not or hardly sucking water. The facing member 53 has a planar shape having generally the same size as that of the ejection face 10*a* in the main scanning direction and the sub-scanning direction. When facing the ejection face 10*a*, the facing face 80 receives the ink ejected or discharged from the ejection openings 14*a* by the forced ejection, for example. It is noted that the ink received by the facing face 80 is sent to a waste liquid portion, not shown, such as a tank.

Two openings 30, 31 (as one example of a first opening and a second opening) are respectively formed in opposite end portions of the facing face 80 in the main scanning direction. In the humidifying maintenance, supply of humid air humidified in a tank 64 which will be described below into the ejection space V1 via the opening 30 and supply of humid air into the ejection space V1 via the opening 31 are alternately performed. In other words, discharge of the air from the ejection space V1 via the opening 30 and discharge of the air from the ejection space V1 via the opening 30 are alternately performed. As shown in FIG. 2, the two openings 30, 31 are respectively arranged at positions respectively facing opposite end portions of the ejection face 10*a* in the main scanning direction in the state in which the facing face 80 faces the ejection face 10*a*. That is, all the ejection openings 14*a* are located in plan view between the two openings 30, 31 in the main scanning direction. In other words, the two openings 30, 31 are respectively arranged at positions interposing all the ejection openings 14*a* (as a part of the ejection face 10*a*) therebetween in the main scanning direction.

There will be next explained a structure of the humidification unit 60 with reference to FIGS. 5 and 6.

As shown in FIG. 5, the humidification unit 60 includes tubes 65*a*-65*e*, a switching valve 66, a pump 63, and the tank 64. The tube 65*a* connects between the opening 31 and the switching valve 66. The tube 65*b* connects between the switching valve 66 and the pump 63. The tube 65*c* connects between the pump 63 and the tank 64. The tube 65*d* connects between the tank 64 and the switching valve 66. The tube 65*e* connects between the switching valve 66 and the opening 30.

The tank 64 (as one example of a generating portion) stores water in its lower space and stores in its upper space the humid air humidified by the water in the lower space. The tube 65*c* is connected to a portion of the tank 64 below a water surface in the tank 64 so as to communicate with the lower space of the tank 64. The tube 65*d* is connected to a portion of the tank 64 above the water surface in the tank 64 so as to communicate with the upper space of the tank 64. The switching valve 66 is controlled by the controller 100 so as to selectively take (i) a first switched state (see FIG. 5) in which the tube 65*a* and the tube 65*b* communicate with each other, and the tube 65*d* and the tube 65*e* communicate with each other and (ii) a second switched state (see FIG. 6) in which the tube 65*a* and the tube 65*d* communicate with each other, and the tube 65*b* and the tube 65*e* communicate with each other. The pump 63 is controlled by the controller 100 to generate air circulation between the ejection space V1 and the tank 64. It is noted that, when the water in the tank 64 has decreased, water is replenished into the tank 64 from a water replenish tank, not shown.

As shown in FIG. 5, when the pump 63 is driven by the controller 100 with the switching valve 66 being in the first switched state, air collected from the ejection space V1 via the opening 31 and the tubes 65*a*, 65*b*, 65*c* is humidified in the tank 64, and this humidified air (humid air) is then supplied into the ejection space V1 via the tubes 65*d*, 65*e* and the opening 30. As shown in FIG. 6, when the pump 63 is driven by the controller 100 with the switching valve 66 being in the second switched state, the air collected from the ejection space V1 through the opening 30 and the tubes 65*e*, 65*b*, 65*c* is humidified in the tank 64, and this humidified air (humid air) is then supplied into the ejection space V1 through the tubes 65*d*, 65*a* and the opening 31. In this air circulation between the ejection space V1 and the tank 64, air having a relatively high humidity is reused for the humidification, leading to a lower consumption of the water in the tank 64 as a humidification source. The humidification of the ejection space V1 can eliminate or resolve a thickening of the ink near the ejection openings 14*a* to prevent clogging of the ejection openings 14*a*. It is noted that a check valve, not shown, is disposed in the tube 65*c* to prevent the water in the tank 64 from flowing into the pump 63. In the present embodiment, the pump 63, the tubes 65*a*-65*e*, and the switching valve 66 are one example of a supply portion.

Figure 7:
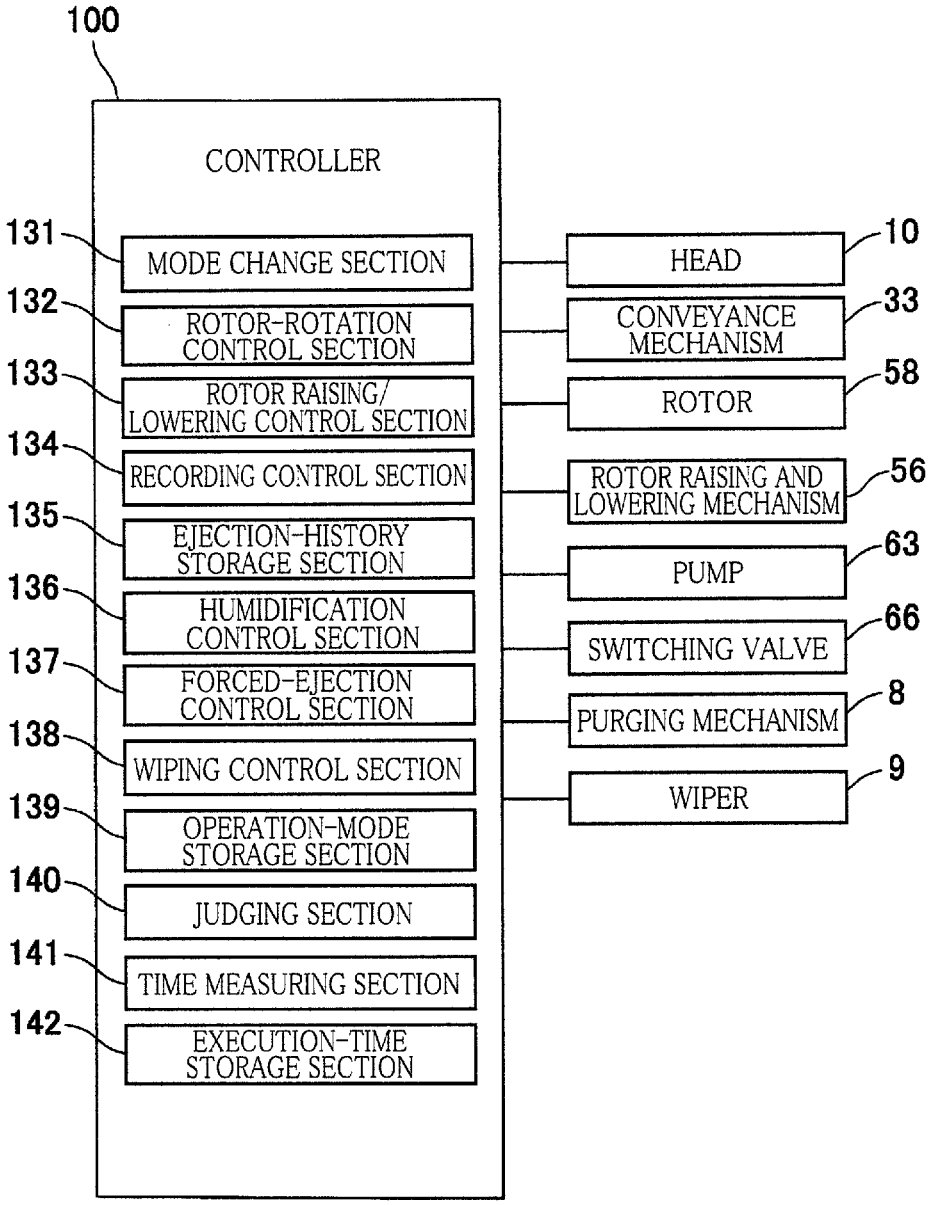
FIG. 7 is a block diagram showing an electric configuration of the printer in FIG. 1.

There will be next explained the controller 100 in detail with reference to FIG. 7. The controller 100 includes a central processing unit (CPU), a read only memory (ROM) rewritably storing therein programs to be executed by the CPU and data used for these programs; a random access memory (RAM) temporarily storing therein data upon the execution of the program. Control programs are stored in the ROM. When the control programs are executed by the CPU, various functional sections of the controller 100 shown in FIG. 7 are operated. The controller 100 transmits and receives data to and from the external device such as a personal computer (PC) via an I/F.

As shown in FIG. 7, the controller 100 is for controlling overall components and operations of the printer 1 and includes a mode change section 131, a rotor-rotation control section 132, a rotor raising/lowering control section 133, a recording control section 134, an ejection-history storage section 135, a humidification control section 136, a forced-ejection control section 137, a wiping control section 138, an operation-mode storage section 139 storing an operation mode of the printer 1, a judging section 140, a time measuring section 141, and an execution-time storage section 142.

The mode change section 131 changes the operation mode stored in the operation-mode storage section 139. Specifically, when the recording data has been received from the external device, the mode change section 131 changes the operation mode of the printer 1 to the recording mode. When the image recording based on the recording data is finished, the mode change section 131 changes the operation mode to the recording waiting mode. When new recording data has not been received for a predetermined length of time after the image recording based on the recording data is finished, the mode change section 131 changes the operation mode to the maintenance mode. The operation-mode storage section 139 stores one of the recording mode, the recording waiting mode, and the maintenance mode.

When the mode change section 131 has changed the operation mode from the recording waiting mode to the maintenance mode, the rotor-rotation control section 132 controls the rotor 58 such that its state is changed from the first rotation state to the second rotation state. When the mode change section 131 has changed the operation mode from the maintenance mode to the recording mode, the rotor-rotation control section 132 controls the rotor 58 such that its state is changed from the second rotation state to the first rotation state.

When the mode change section 131 has changed the operation mode from the recording waiting mode to the maintenance mode, the rotor raising/lowering control section 133 controls the rotor raising and lowering mechanism 56 to be moved upward such that the recessed member 52 is moved upward from the distant position to the contact position. When the mode change section 131 has changed the operation mode from the maintenance mode to the recording mode, the rotor raising/lowering control section 133 controls the rotor raising and lowering mechanism 56 to be moved downward such that the recessed member 52 is moved downward from the contact position to the distant position.

On the basis of the recording data (including ink ejection data and conveyance data) transmitted from the external device, the recording control section 134 executes a processing for the image recording by controlling the head 10 and the conveyance mechanism 33 such that the ink is ejected onto the sheet P. It is noted that, in the present embodiment, the ink ejection data indicates an amount of the ink ejected from each ejection opening 14*a* at each recording period, specifically, the ink ejection data indicates one of four amounts, namely, zero, a small amount, a medium amount, and a large amount, as each ink amount. When the recording data has been received during the humidifying maintenance, the recording control section 134 controls the head 10 and the conveyance mechanism 33 to record the image on the basis of the recording data after a cancellation of the humidifying maintenance.

The ejection-history storage section 135 stores therein an ejection history of each ejection opening 14*a* through which the ink is ejected onto the sheet P on the basis of the recording data. It is noted that, each time when new recording data has been received, the ejection-history storage section 135 deletes an ink ejection history of all the ejection openings 14*a* which pertains to the recording based on the preceding or most-recently used recording data, and then stores the ink ejection history of all the ejection openings 14*a* which pertains to the recording based on recording data received at this time (i.e., latest or current recording data).

Here, the ejection openings 14*a* can be divided into two groups with respect to a center of the ejection face 10*a* in the main scanning direction. That is, the ejection openings 14*a* includes ejection openings 14*a* (one ejection-opening group) as one example of first-opening-side ejection openings located on one side of the center of the ejection face 10*a* in the main scanning direction, and ejection openings 14*a* (the other ejection-opening group) as one example of second-opening-side ejection openings located on the other side of the center of the ejection face 10*a* in the main scanning direction. On the basis of the ejection history stored in the ejection-history storage section 135, the judging section 140 judges whether a greater amount of the ink has been ejected from the ejection openings 14*a* located on the one side of the center of the ejection face 10*a* or from the ejection openings 14*a* located on the other side of the center of the ejection face 10*a*. In other words, the judging section 140 judges which of the one ejection-opening group and the other ejection-opening group a greater amount of the ink has been ejected from. Where the humidification control section 136 executes a current humidifying maintenance processing (a maintenance processing) in the maintenance mode, an ejection history of the latest one of image recording processings executed before the mode change section 131 has changed the operation mode to the current maintenance mode is the preceding or most recent ejection history stored in the ejection-history storage section 135. Thus, the judging section 140 judges which of the ejection openings 14*a* located on the one side of the center of the ejection face 10*a* and the ejection openings 14*a* located on the other side of the center of the ejection face 10*a*, a greater amount of the ink has been ejected from, on the basis of the ejection history (stored in the ejection-history storage section 135) corresponding to the recording data used for the preceding or most recent image recording processing. Further, the one side of the ejection face 10*a* is an area which includes a position facing the opening 30 in the sealing state and at which there are the ejection openings 14*a* located on the one side of a center line and nearer to a one-side end portion of the ejection face 10*a* than to an other-side end portion thereof. The center line is a line distant from the one-side end portion and the other-side end portion of the ejection face 10*a* in the main scanning direction by an equal distance. The center line is a line parallel to the sub-scanning direction. On the other hand, the other side is an area which includes a position facing the opening 31 in the sealing state and at which there are the ejection openings 14*a* located on the other side of the center line and nearer to the other-side end portion of the ejection face 10*a* than to the one-side end portion thereof. Thus, the judging section 140 judges which of the ejection openings 14*a* located on the one side of the center of the ejection face 10*a* and the ejection openings 14*a* located on the other side of the center of the ejection face 10*a*, a greater amount of the ink has been ejected from, by comparing the amount of the ink ejected from the ejection openings 14*a* nearer to the one-side end portion on the one side of the center line and the amount of the ink ejected from the ejection openings 14*a* nearer to the other-side end portion on the other side of the center line with each other.

The time measuring section 141 (as one example of a measuring portion) measures (i) a first execution time that is a length of time for which the humid air has been supplied from the opening 30 (i.e., a length of time of the first switched state during the operation of the pump 63) and (ii) a second execution time that is a length of time for which the humid air has been supplied from the opening 31 (i.e., a length of time of the second switched state during the operation of the pump 63). The execution-time storage section 142 stores the first and second execution times measured by the time measuring section 141. It is noted that, each time when the humidifying maintenance has been performed, the execution-time storage section 142 deletes the first and second execution times in the preceding humidifying maintenance and stores the first and second execution times in the current humidifying maintenance.

When the operation mode stored in the operation-mode storage section 139 is the maintenance mode, the humidification control section 136 controls the pump 63 and the switching valve 66 to perform the humidifying maintenance so as to humidify the air in the ejection space V1. More specifically, the humidification control section 136 controls the switching valve 66 in the sealing state such that the number of the supply operations for supplying the humid air into the ejection space V1 through the opening 30 and the number of the supply operations for supplying the humid air into the ejection space V1 through the opening 31 are the same as each other and such that a length of time of the supply operations through the opening 30 and a length of time of the supply operations through the opening 31 are the same as each other. In the present embodiment, two humid-air supply operations through the opening 30 each lasting for five seconds and two humid-air supply operations through the opening 31 each lasting for five seconds are alternately performed. That is, a first supply time (a total or accumulative time of the two supply operations) for which the humid air is supplied from the opening 30 into the ejection space V1 is ten seconds, and a second supply time (a total or accumulative time of the two supply operations) for which the humid air is supplied from the opening 31 into the ejection space V1 is ten seconds.

Where the judging section 140 has judged that the amount of the ink ejected from the ejection openings 14*a* located on the one side of the center of the ejection face 10*a* is larger, the humidification control section 136 controls the switching valve 66 so as to supply the humid air through the opening 31 and then supply the humid air through the opening 30. That is, the humidification control section 136 controls the switching valve 66 to take the second switched state first and then the first switched state. On the other hand, where the judging section 140 has judged that the amount of the ink ejected from the ejection openings 14*a* located on the other side of the center of the ejection face 10*a* is larger, the humidification control section 136 controls the switching valve 66 so as to supply the humid air through the opening 30 and then supply the humid air through the opening 31. That is, the humidification control section 136 controls the switching valve 66 to take the first switched state first and then the second switched state. It is noted that, where the judging section 140 has judged that the amount of the ink ejected from the ejection openings 14*a* located on the one side and the amount of the ink ejected from the ejection openings 14*a* located on the other side are the same as each other, the humidification control section 136 controls the switching valve 66 on the basis of the ejection history stored in the ejection-history storage section 135, such that a current humid-air supply operation is performed so as for the humid air to be supplied through the opening 30 or 31 through which the humid air has been supplied in the last humid-air supply operation in the preceding or most recent humidifying maintenance processing. That is, where the humidification control section 136 executes the current humidifying maintenance processing (this humidifying maintenance processing) in the maintenance mode, the latest one of humidifying maintenance processings executed before the mode change section 131 has changed the operation mode to the current maintenance mode is the preceding or most recent humidifying maintenance processing. As a result, there is no need to perform an unnecessary operation for switching the state of the switching valve 66 upon supplying the humid air, leading to a speedy start of the current humid-air supply operation.

When the recording data has been received during the current humidifying maintenance, the humidification control section 136 controls the switching valve 66 such that the humid air is supplied into the ejection space V1 through the opening 30 or 31 used for a shorter one of the first and second execution times stored in the execution-time storage section 142, in order to have the shorter execution time become equal to a longer one of the first and second execution times. The humidification control section 136 then stops the pump 63 to cancel the humid-air supply operation in the current humidifying maintenance.

When the mode change section 131 changes the operation mode stored in the operation-mode storage section 139 from the maintenance mode to the recording mode, for example, the forced-ejection control section 137 controls the purging mechanism 8 to force the head 10 to eject the ink onto the facing face 80, that is, the forced-ejection control section 137 controls the purging mechanism 8 to perform the purging as the forced ejection maintenance. The forced-ejection control section 137 controls the purging mechanism 8 to perform the purging in the present embodiment but may control the head 10 to perform the flushing as the forced ejection maintenance.

When the forced ejection maintenance performed by the control of the forced-ejection control section 137 is completed, the wiping control section 138 controls the wiper 9 to wipe the ejection face 10*a* to remove foreign matters thereon. It is noted that the wiper 9 is a plate-like member formed of an elastic material such as rubber and extending in the sub-scanning direction. The wiping control section 138 controls the wiper 9 to move in the main scanning direction while contacting the ejection face 10*a*, thereby removing the foreign matters such as the ink on the ejection face 10*a*.

Figure 8A:
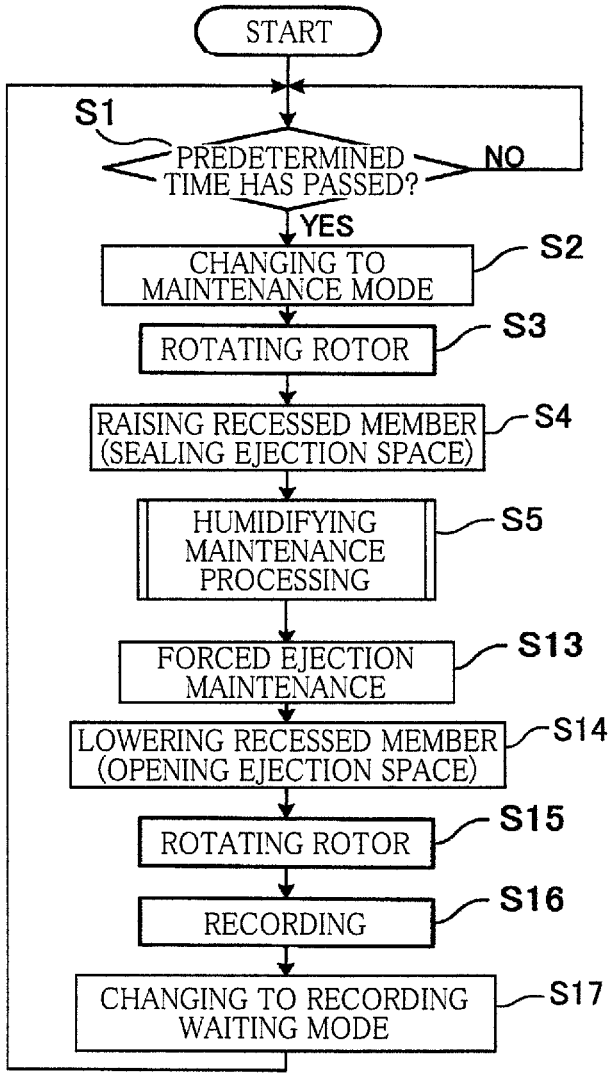
FIG. 8A is a flow-chart showing an operation flow of a humidifying maintenance controlled by a controller of the printer in FIG. 1.
Figure 8B:
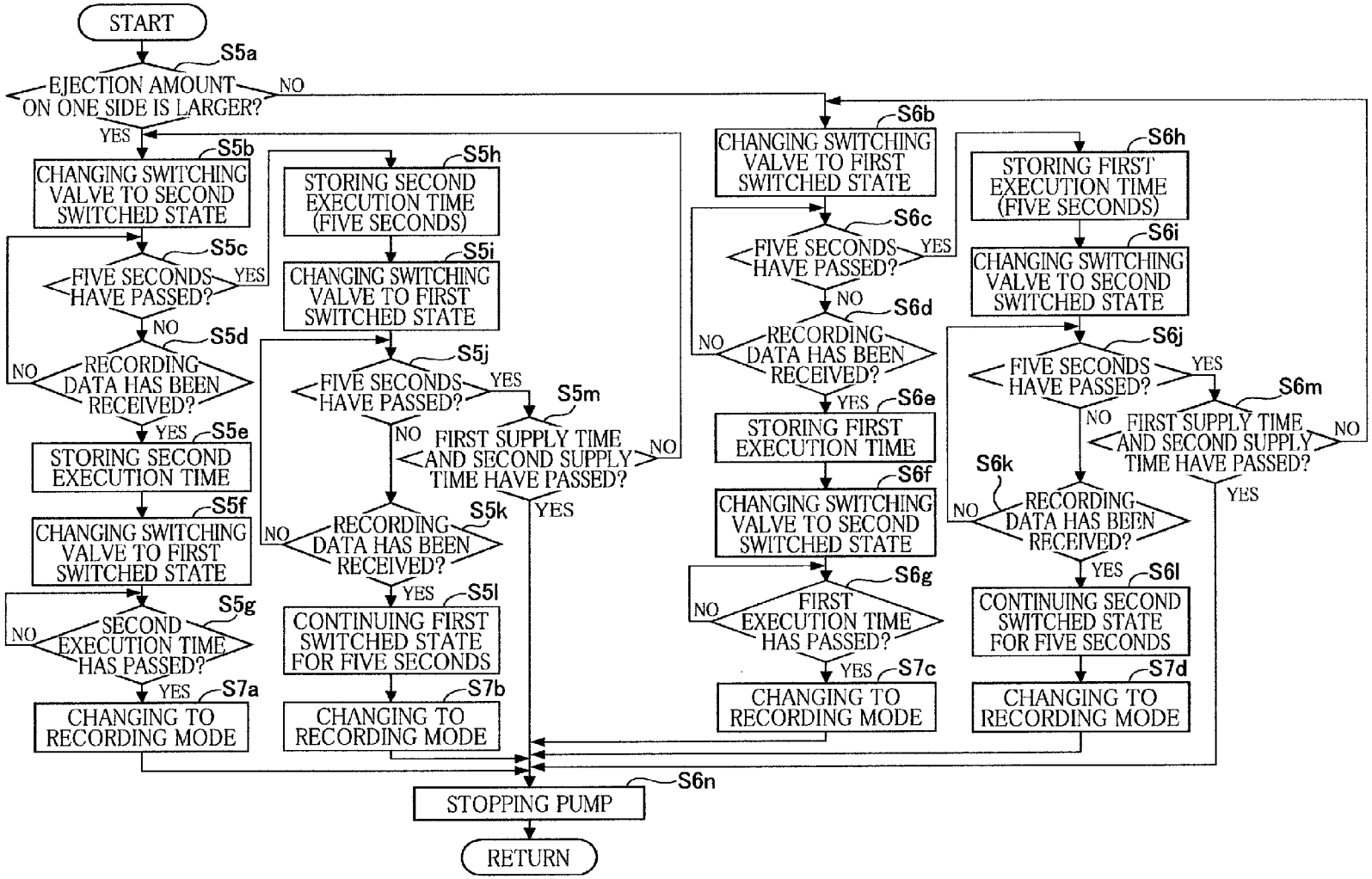
FIG. 8B is a flow-chart showing a humidifying maintenance processing in FIG. 8A.

There will be next explained an operation flow of the humidifying maintenance with reference to FIGS. 8A and 8B. FIG. 8B is a flow-chart for a detailed explanation of the humidifying maintenance processing in S5 in FIG. 8A. It is noted that the recording waiting mode is stored as the operation mode in the operation-mode storage section 139 at a start of the operation flow in FIG. 8A.

Initially in S1, the mode change section 131 judges whether the predetermined length of time has passed (elapsed) from a completion of the image recording performed by the control of the recording control section 134. Where the mode change section 131 has judged that the predetermined length of time has not passed (S1: NO), the controller 100 repeats the processing in S1. It is noted that, where the recording data has been received from the external device before the predetermined length of time has passed, the mode change section 131 changes the operation mode stored in the operation-mode storage section 139 to the recording mode, and the recording control section 134 executes the image recording processing based on the recording data.

On the other hand, where the mode change section 131 has judged that the predetermined length of time has passed (S1: YES), the mode change section 131 in S2 changes the operation mode stored in the operation-mode storage section 139 to the maintenance mode. Then in S3, the rotor-rotation control section 132 rotates the rotor 58 such that its state is changed from the first rotation state to the second rotation state. As a result, the facing face 80 of the facing member 53 faces the ejection face 10*a*.

Then in S4, the rotor raising/lowering control section 133 controls the rotor raising and lowering mechanism 56 to move the rotor 58 upward, thereby moving the recessed member 52 upward from the distant position to the contact position. As a result, the distal end 54*a* of the annular member 54 of the recessed member 52 is held in contact with the ejection face 10*a*, so that the ejection space V1 under the ejection face 10*a* is sealed or isolated from the outside space V2.

Then in S5, the humidification control section 136 drives the pump 63 and the switching valve 66 so as to generate the air circulation between the ejection space V1 and the tank 64, that is, the humidification control section 136 executes the humidifying maintenance processing. Here, the humidifying maintenance processing in S5 will be explained with reference to FIG. 8B. Initially, where the judging section 140 has judged that the amount of the ink ejected from the ejection openings 14*a* located on the one side of the center of the ejection face 10*a* is larger than that on the other side (S5*a*: YES), the humidification control section 136 in S5*b* controls the switching valve 66 to take the second switched state and drives the pump 63. Then in S5*c*, the humidification control section 136 judges whether five seconds have passed from a point in time when the state of the switching valve 66 had been changed to the second switched state. Where the humidification control section 136 has judged that five seconds have not passed (S5*c*: NO), the controller 100 in S5*d* judges whether the printer 1 has received the recording data. Where the controller 100 has judged that the printer 1 has not received the recording data (S5*d*: NO), the humidification control section 136 continues the second switched state of the switching valve 66 and the driving of the pump 63. On the other hand, where the controller 100 has judged that the printer 1 has received the recording data (S5*d*: YES), the humidification control section 136 in S5*e* stores the second execution time measured by the time measuring section 141 into the execution-time storage section 142. Then in S5*f*, the humidification control section 136 controls the switching valve 66 to take the first switched state and continues the driving of the pump 63. Then in S5*g*, the humidification control section 136 judges whether a length of time elapsed from a point in time when the state of the switching valve 66 had been changed to the first switched state has reached the second execution time stored in S5*e*. Where the humidification control section 136 has judged that the second execution time has not passed (S5*g*: NO), the humidification control section 136 continues the first switched state of the switching valve 66 and the driving of the pump 63. On the other hand, where the humidification control section 136 has judged that the second execution time has passed (S5*g*: YES), the humidification control section 136 judges that the length of time of the first switched state of the switching valve 66 and the length of time of the second switched state of the switching valve 66 has become equal to each other. Then in S7*a*, the mode change section 131 changes the operation mode to the recording mode. Then in S6*n*, the humidification control section 136 stops the pump 63, and this humidifying maintenance processing is finished.

Where the humidification control section 136 has judged in S5*c* that five seconds have passed from the point in time when the state of the switching valve 66 had been changed to the second switched state in S5*b* (S5*c*: YES), the humidification control section 136 in S5*h* stores the second execution time into the execution-time storage section 142. It is noted that the storage of the second execution time into the execution-time storage section 142 in S5*h* may be performed by the humidification control section 136 judging that the second execution time is five seconds on the basis of the positive decision in S5*c* and by setting the time measured by the time measuring section 141 (five seconds) as the second execution time. Then, the humidification control section 136 in S5*i* changes the state of the switching valve 66 to the first switched state while continuing the driving of the pump 63, and in S5*j* judges whether five seconds have passed from a point in time when the state of the switching valve 66 had been changed to the first switched state. Where the humidification control section 136 has judged that five seconds have not passed from the point in time when the state of the switching valve 66 had been changed to the first switched state (S5*j*: NO), the controller 100 judges in S5*k* whether the printer 1 has received the recording data or not. Where the controller 100 has judged that the printer 1 has not received the recording data (S5*k*: NO), the humidification control section 136 continues the first switched state of the switching valve 66 and the driving of the pump 63. On the other hand, where the controller 100 has judged that the printer 1 has received the recording data (S5*k*: YES), the humidification control section 136 in S51 continues the first switched state of the switching valve 66 for five seconds while continuing the driving of the pump 63, making the length of time of the first switched state of the switching valve 66 and the length of time of the second switched state of the switching valve 66 become equal to each other. Then in S7*b*, the mode change section 131 changes the operation mode to the recording mode. Then in S6*n*, the humidification control section 136 stops the pump 63, and this humidifying maintenance processing is finished.

Where the humidification control section 136 has judged in S5*j* that five seconds have passed from the point in time when the state of the switching valve 66 had been changed to the first switched state (S5*j*: YES), the humidification control section 136 judges in S5*m* whether the humid air has been supplied into the ejection space V1 from the opening 30 for the first supply time and from the opening 31 for the second supply time from the start of the current humidifying maintenance processing. Where the humidification control section 136 has judged that the humid air has not been supplied into the ejection space V1 for the first supply time and the second supply time (S5*m*: NO), the humidification control section 136 in S5*b* changes the state of the switching valve 66 to the second switched state again. In S5*b*, the driving of the pump 63 is continued. On the other hand, where the humidification control section 136 has judged in S5*m* that the humid air has been supplied into the ejection space V1 for the first supply time and the second supply time (S5*m*: YES), the humidification control section 136 judges that the humid air has been supplied into the ejection space V1 from the opening 30 for the first supply time (ten seconds) and from the opening 31 for the second supply time (ten seconds) in the current humidifying maintenance processing. Then in S6*n*, the humidification control section 136 stops the pump 63, and this humidifying maintenance processing is finished.

On the other hand, where the judging section 140 has judged in S5*a* that the amount of the ink ejected from the ejection openings 14*a* located on the one side of the center of the ejection face 10*a* is not larger than that on the other side (S5*a*: NO), the humidification control section 136 in S6*b* controls the switching valve 66 to take the first switched state and drives the pump 63. Then in S6*c*, the humidification control section 136 judges whether five seconds have passed from a point in time when the state of the switching valve 66 had been changed to the first switched state. Where the humidification control section 136 has judged that five seconds have not passed (S6*c*: NO), the controller 100 in S6*d* judges whether the printer 1 has received the recording data. Where the controller 100 has judged that the printer 1 has not received the recording data (S6*d*: NO), the humidification control section 136 continues the first switched state of the switching valve 66 and the driving of the pump 63. On the other hand, where the controller 100 has judged that the printer 1 has received the recording data (S6*d*: YES), the humidification control section 136 in S6*e* stores the first execution time measured by the time measuring section 141 into the execution-time storage section 142. Then in S6*f*, the humidification control section 136 controls the switching valve 66 to take the second switched state and continues the driving of the pump 63. Then in S6*g*, the humidification control section 136 judges whether a length of time elapsed from a point in time when the state of the switching valve 66 had been changed to the second switched state has reached the first execution time stored in S6*e*. Where the humidification control section 136 has judged that the second execution time has not passed (S6*g*: NO), the humidification control section 136 continues the second switched state of the switching valve 66 and the driving of the pump 63. On the other hand, where the humidification control section 136 has judged that the first execution time has passed (S6*g*: YES), the humidification control section 136 judges that the length of time of the first switched state of the switching valve 66 and the length of time of the second switched state of the switching valve 66 has become equal to each other. Then in S7*c*, the mode change section 131 changes the operation mode to the recording mode. Then in S6*n*, the humidification control section 136 stops the pump 63, and this humidifying maintenance processing is finished.

Where the humidification control section 136 has judged in S6*c* that five seconds have passed from the point in time when the state of the switching valve 66 had been changed to the first switched state in S6*b* (S6*c*: YES), the humidification control section 136 in S6*h* stores the first execution time into the execution-time storage section 142. Then, the humidification control section 136 in S6*i* changes the state of the switching valve 66 to the second switched state while continuing the driving of the pump 63, and in S6*j* judges whether five seconds have passed from a point in time when the state of the switching valve 66 had been changed to the second switched state. Where the humidification control section 136 has judged that five seconds have not passed from the point in time when the state of the switching valve 66 had been changed to the second switched state (S6*j*: NO), the controller 100 judges in S6*k* whether the printer 1 has received the recording data or not. Where the controller 100 has judged that the printer 1 has not received the recording data (S6*k*: NO), the humidification control section 136 continues the second switched state of the switching valve 66 and the driving of the pump 63. On the other hand, where the controller 100 has judged that the printer 1 has received the recording data (S6*k*: YES), the humidification control section 136 in S61 continues the second switched state of the switching valve 66 for five seconds while continuing the driving of the pump 63, making the length of time of the first switched state of the switching valve 66 and the length of time of the second switched state of the switching valve 66 become equal to each other. Then in S7*d*, the mode change section 131 changes the operation mode to the recording mode. Then in S6*n*, the humidification control section 136 stops the pump 63, and this humidifying maintenance processing is finished.

Where the humidification control section 136 has judged in S6*j* that five seconds have passed from the point in time when the state of the switching valve 66 had been changed to the second switched state (S6*j*: YES), the humidification control section 136 judges in S6*m* whether the humid air has been supplied into the ejection space V1 from the opening 30 for the first supply time and from the opening 31 for the second supply time from the start of the current humidifying maintenance processing. Where the humidification control section 136 has judged that the humid air has not been supplied into the ejection space V1 for the first supply time and the second supply time (S6*m*: NO), the humidification control section 136 in S6*b* changes the state of the switching valve 66 to the first switched state again. In S6*b*, the driving of the pump 63 is continued. On the other hand, where the humidification control section 136 has judged in S6*m* that the humid air has been supplied into the ejection space V1 for the first supply time and the second supply time (S6*m*: YES), the humidification control section 136 judges that the humid air has been supplied into the ejection space V1 from the opening 30 for the first supply time (ten seconds) and from the opening 31 for the second supply time (ten seconds) in the current humidifying maintenance processing. Then in S6*n*, the humidification control section 136 stops the pump 63, and this humidifying maintenance processing is finished.

As described above, where the printer 1 has not received the recording data from the external device in the maintenance mode and where the judging section 140 has judged that the amount of the ink ejected from the ejection openings 14*a* located on the one side of the center of the ejection face 10*a* is larger than that on the other side, the humidification control section 136 changes the state of the switching valve 66 to the second switched state first and, each time when five seconds have passed, the humidification control section 136 changes the state of the switching valve 66 from the second switched state to the first switched state, the second switched state, and the first switched state in order such that each state extends for five seconds. On the other hand, where the printer 1 has not received the recording data from the external device in the maintenance mode and where the judging section 140 has judged that the amount of the ink ejected from the ejection openings 14*a* located on the other side of the center of the ejection face 10*a* is larger than that on the one side, the humidification control section 136 changes the state of the switching valve 66 to the first switched state and drives the pump 63. Then, each time when five seconds have passed, the humidification control section 136 changes the state of the switching valve 66 from the first switched state to the second switched state, the first switched state, and the second switched state in order. This humidifying maintenance for supplying the humid air from the openings 30 and 31 alternately makes it possible to make a humidity of the ejection space V1 uniform in the main scanning direction for a relatively short time. Thus, it is also possible to resolve a thickening of the ink near the opening 30 and the opening 31 for a relatively short time.

Returning to the flow-chart in FIG. 8A, the forced-ejection control section 137 in S13 controls the purging mechanism 8 to perform the forced ejection maintenance by forcing the head 10 to eject the ink onto the facing face 80. It is noted that the ink forced to be ejected on the facing face 80 is sent to the waste liquid portion. It is further noted that the amount of the ink forced to be ejected in this forced ejection maintenance is greater in the case where the humidifying maintenance has been canceled (that is, the flow goes through one of S7*a*-7*d*) than in the case where the humidifying maintenance is completed (that is, the flow goes through the positive decision in S5*m* or S6*m*.

Then in S14, the rotor raising/lowering control section 133 controls the rotor raising and lowering mechanism 56 to move the rotor 58 downward to lower the recessed member 52 from the contact position to the distant position. As a result, the distal end 54*a* of the annular member 54 of the recessed member 52 comes off the ejection face 10*a*, whereby the ejection space V1 under the ejection face 10*a* opens to or communicates with the outside space V2. It is noted that, in this processing (S14), the wiping control section 138 also performs the processing for controlling the wiper 9 to remove the foreign matters on the ejection face 10*a* after the recessed member 52 is lowered from the contact position to the distant position.

Then in S15, the rotor-rotation control section 132 rotates the rotor 58 such that its state is changed from the second rotation state to the first rotation state. As a result, the support face 51*a* of the platen 51 faces the ejection face 10*a*.

Then in S16, the recording control section 134 controls the head 10 and the conveyance mechanism 33 to record the image on the sheet P on the basis of the recording data. Then in S17, the mode change section 131 changes the operation mode stored in the operation-mode storage section 139 to the recording waiting mode upon the completion of the image recording based on the recording data, and the controller 100 returns to S1.

As described above, in the present embodiment, a period in which the humid air is supplied via the opening 30 and a period in which the humid air is supplied via the opening 31 do not overlap each other in the current humidifying maintenance processing (current humid-air supply processing). Specifically, the humid air is supplied from the two openings 30, 31 alternately in the humidifying maintenance, less causing a variation in the humidity of the ejection space V1 in the main scanning direction. That is, the humidity of the ejection space V1 in the sealing state can be made uniform for a relatively short time.

Further, the operation for supplying the humid air into the ejection space V1 in the humidifying maintenance is performed first from one of the opening 30 and the opening 31 on which side the ink ejection amount is smaller. In other words, the humid air is supplied from a side (on the ejection face 10*a*) on which the ink in the ejection openings 14*a* dries more speedily. Thus, viscosities of the ink in the plurality of ejection openings 14*a* can be made uniform for a relatively short time.

As a modification, on the basis of the ejection history stored in the ejection-history storage section 135, the judging section 140 may judge which of the ejection openings 14*a* located on the one side of the center of the ejection face 10*a* and the ejection openings 14*a* located on the other side of the center, the number of the ink ejections is greater. In other words, the judging section 140 may judge which is greater in the number of the ink ejections, the ejection openings 14*a* located on the one side of the center of the ejection face 10*a* or the ejection openings 14*a* located on the other side of the center. Where the judging section 140 has judged that the number of the ink ejections from the ejection openings 14*a* located on the one side is greater than that on the other side, the humidification control section 136 controls the switching valve 66 such that the humid air is supplied from the opening 31 and then from the opening 30. On the other hand, where the judging section 140 has judged that the number of the ink ejections from the ejection openings 14*a* located on the other side is greater than that on the one side, the humidification control section 136 controls the switching valve 66 such that the humid air is supplied from the opening 30 and then from the opening 31. This configuration can also achieve the same effects as provided by the above-described embodiment.

As another modification, the humidification control section 136 may control the switching valve 66 such that the current humid-air supply operation is performed so as for the humid air to be supplied through the opening 30 or 31 through which the humid air has been supplied in the last humid-air supply operation in the preceding or most recent humidifying maintenance processing, without based on the ejection history stored in the ejection-history storage section 135. In this configuration, there is no need to provide the ejection-history storage section 135 and the judging section 140, enabling a simpler configuration. Further, there is no need to perform an unnecessary operation for switching the opening to be used upon supplying the humid air, enabling a quick start of the current humid-air supply operation.

In the above-described embodiment, the first supply time and the second supply time in the humidifying maintenance are equal to each other. Thus, the humidity of the ejection space V1 can be made uniform in the main scanning direction for a shorter time.

As another modification, this printer 1 may be configured such that, where the judging section 140 has judged that the amount of the ink ejected (or the number of the ink ejections) from the ejection openings 14*a* located on the one side of the center of the ejection face 10*a* is greater, the humidification control section 136 controls the switching valve 66 such that the second supply time becomes longer than the first supply time, and such that, where the judging section 140 has judged that the amount of the ink ejected (or the number of the ink ejections) from the ejection openings 14*a* located on the other side of the center of the ejection face 10*a* is greater, the humidification control section 136 controls the switching valve 66 such that the first supply time becomes longer than the second supply time. As a result, more humid air is supplied to the ejection openings 14*a* located on a side of the center of the ejection face 10*a*, on which the ink dries more quickly, making it possible to effectively prevent the ink in the ejection openings 14*a* from drying.

Further, when the recording data has been received during the humidifying maintenance, the humidification control section 136 makes equal the first and second execution times for which the humid air has been supplied into the ejection space V1 and then cancels the humidifying maintenance. Since the first and second execution times are made equal to each other, the humid-air supply operation can be canceled in a state in which the viscosities of the ink in the plurality of ejection openings 14*a* are made uniform, resulting in stable ink ejection.

As another modification, the mode change section 131 changes the operation mode to the maintenance mode when the user has operated a power-source switch, not shown, of the printer 1, and thereby the controller 100 has received a power-source OFF signal for turning off the power source of the printer 1 and a sleep signal (a wait signal) for changing a mode of the printer 1 to a power save mode. In the case of the maintenance mode caused by the reception of the power-source OFF signal and the sleep signal, the humidification control section 136 controls the pump 63 and the switching valve 66 to supply the humid air from the opening 30 (or the opening 31) into the ejection space V1 in the sealing state for a predetermined length of time that is longer than a total of the first and second supply times. On the other hand, in the case of the maintenance mode caused by an operation other than the reception of the power-source OFF signal and the sleep signal (for example, in the case where the mode change section 131 has changed the operation mode to the maintenance mode when new recording data has not been received for the predetermined length of time after the completion of the image recording), the humidification control section 136 controls the pump 63 and the switching valve 66 to supply the humid air into the ejection space V1 in the sealing state from the openings 30, 31 alternately. In this configuration, there is no need to make the humidity of the ejection space V1 uniform for a relatively short time in the power source OFF state and the sleep state, making it possible to reduce a power consumption required for the switch of the openings 30, 31.

Figure 9:
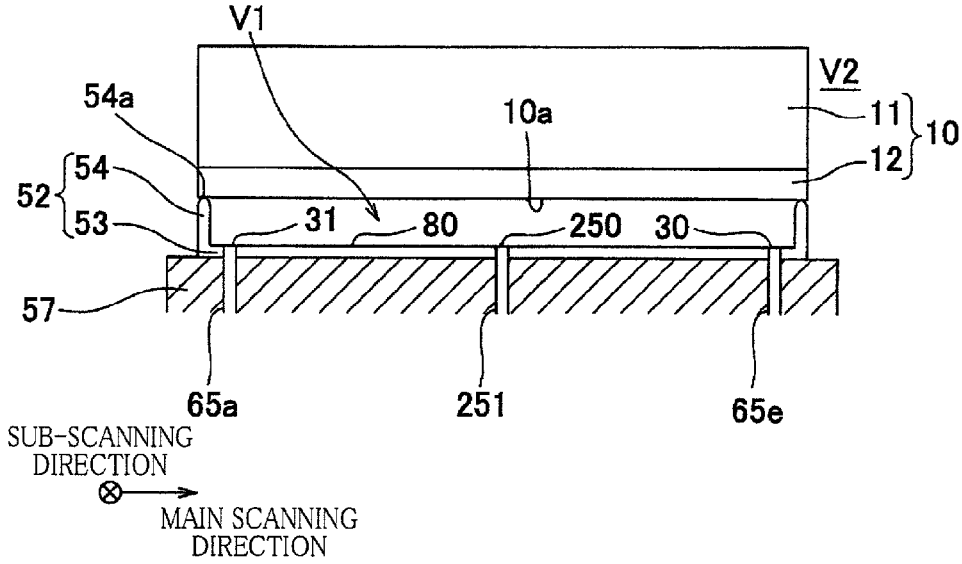
FIG. 9 is an enlarged view showing a main portion of a recessed member in a modification of the embodiment.

As another modification, as shown in FIG. 9, a discharge opening (as one example of a third opening) 250 for discharging the humid air supplied into the ejection space V1 may be formed in a center of the facing face 80 in the main scanning direction and the sub-scanning direction (i.e., a center of a line connecting between the openings 30, 31). A tube 251 is connected to the discharge opening 250. In the tube 251 is provided a relief valve that is set such that the air in the ejection space V1 is discharged to the outside space V2 when the pressure of the ejection space V1 in the sealing state is equal to or higher than an atmospheric pressure and just before the pressure of the ejection space V1 exceeds a meniscus withstanding pressure of meniscuses of the ink in the ejection openings 14*a*. In this case, the supply of the humid air only needs to be preformed from the openings 30, 31 alternately. As thus described, also in the configuration in which only the humid-air supply operation is performed from the two openings 30, 31, providing the discharge opening 250 enables the air in the ejection space V1 to be discharged smoothly.

Figure 10:
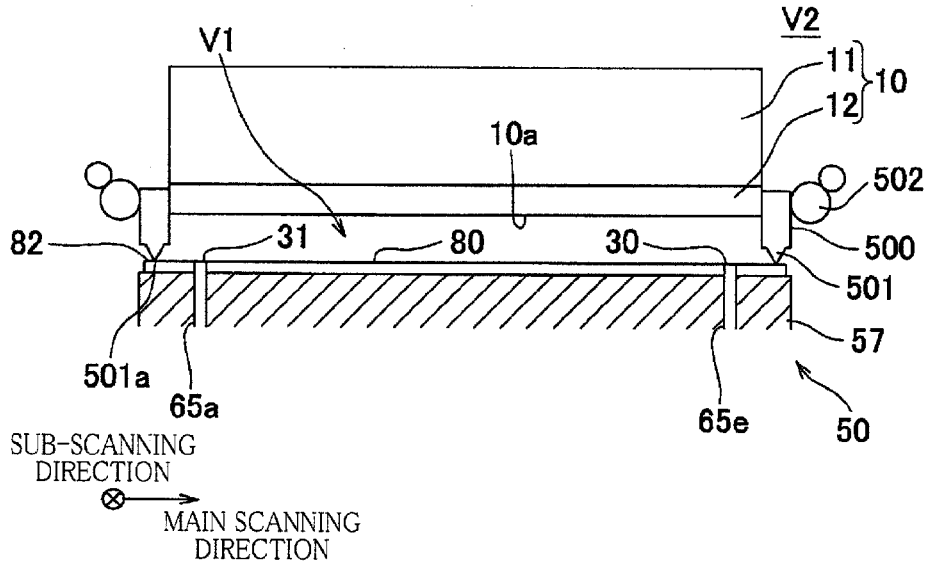
FIG. 10 is an enlarged view showing a main portion of a cap unit in a modification of the embodiment.

In the above-described embodiment, the cap unit can take the sealing state or the unsealing state by the upward or downward movement of the recessed member 52, but as shown in FIG. 10, the printer 1 may be configured such that an annular movable member 500 is provided around the head 10, and the cap unit takes the sealing state or the unsealing state by the upward or downward movement of this annular movable member 500. It is noted that the same reference numerals as used in the above-described embodiment are used to designate the corresponding elements of this modification, and an explanation of which is dispensed with.

In this modification, as shown in FIG. 10, only the facing member 53 (noted that the annular member 54 is omitted from the recessed member 52) is fixed to the cap fixation member 57 instead of the recessed member 52 in the above-described embodiment. The support-cap unit 50 includes the annular movable member 500 instead of the rotor raising and lowering mechanism 56 as described above. The facing member 53 is one size larger than the ejection face 10*a* in the main scanning direction and the sub-scanning direction.

The annular movable member 500 is formed of an elastic material and encloses the ejection face 10*a* of the head 10 in plan view. A lower end of the annular movable member 500 has a projecting portion 501 having an inverted triangle shape in cross section.

The annular movable member 500 is movable upward and downward by gears 502 driven by the control of the controller 100. The annular movable member 500 can be moved to (i) an upper position at which the projecting portion 501 is located above the ejection face 10*a* and (ii) a lower position (see FIG. 10) at which the projecting portion 501 is located below the ejection face 10*a*. The controller 100 controls the gears 502 such that the annular movable member 500 is located at the lower position when the operation mode stored in the operation-mode storage section 139 is the maintenance mode and such that the annular movable member 500 is located at the upper position in situations other than the situation in which the operation mode is the maintenance mode.

As shown in FIG. 10, when the annular movable member 500 is located at the lower position, a distal end 501*a* of the projecting portion 501 is held in contact with a peripheral portion 82 of the facing face 80 such that the ejection space V1 is sealed or isolated from the outside space V2. When the annular movable member 500 is located at the upper position, the distal end 501*a* of the projecting portion 501 is distant from the peripheral portion 82 of the facing face 80 such that the ejection space V1 is open to the outside space V2. In this modification, the annular movable member 500, the gears 502, the facing member 53, and the controller 100 function as the cap unit. This cap unit can achieve the same effects as provided by the above-described embodiment.

As another modification, the openings 30, 31 may be formed in the annular movable member 500. In this case, the openings 30, 31 are arranged at respective positions interposing the ejection face 10*a* therebetween in the main scanning direction. As another modification, the openings 30, 31 may respectively formed in the opposite end portions of the ejection face 10*a* in the main scanning direction. In this case, the two openings 30, 31 are preferably arranged at the respective positions interposing all the ejection openings 14*a* therebetween in the main scanning direction. Also in this modification, it is possible to achieve the same effects as provided by the above-described embodiment.

As another modification, the humidification unit 60 in the above-described embodiment may be a humidification unit 360 shown in FIG. 11. This humidification unit 360 includes eight tubes 365*a*-365*h*, two pumps 363*a*, 363*b*, four opening and closing valves 366*a*-366*d*, and the tank 64. The tube 365*a* connects between the opening 31 and the pump 363*a*. The tube 365*b* is branched so as to connect between the pump 363*a* and the opening and closing valves 366*a*, 366*b*. The tube 365*c* connects between the opening and closing valve 366*a* and the tank 64. The tube 365*d* connects between the opening and closing valve 366*b* and the tank 64. The tube 365*e* connects between the tank 64 and the opening and closing valve 366*c*. The tube 365*f* connects between the tank 64 and the opening and closing valve 366*d*. The tube 365*g* is branched so as to connect between the pump 363*b* and the opening and closing valves 366*c*, 366*d*. The tube 365*h* connects between the opening 30 and the pump 363*b*.

The tubes 365*d*, 365*f* are respectively connected to portions of the tank 64 below the water surface in the tank 64 so as to communicate with the lower space of the tank 64. The tubes 365*c*, 365*e* are respectively connected to portions of the tank 64 above the water surface in the tank 64 so as to communicate with the upper space of the tank 64. It is noted that a check valve is provided in each of the tubes 365*d*, 365*f* for preventing the water in the tank 64 from flowing toward the opening and closing valves 366*b*, 366*d*.

Figure 11A:
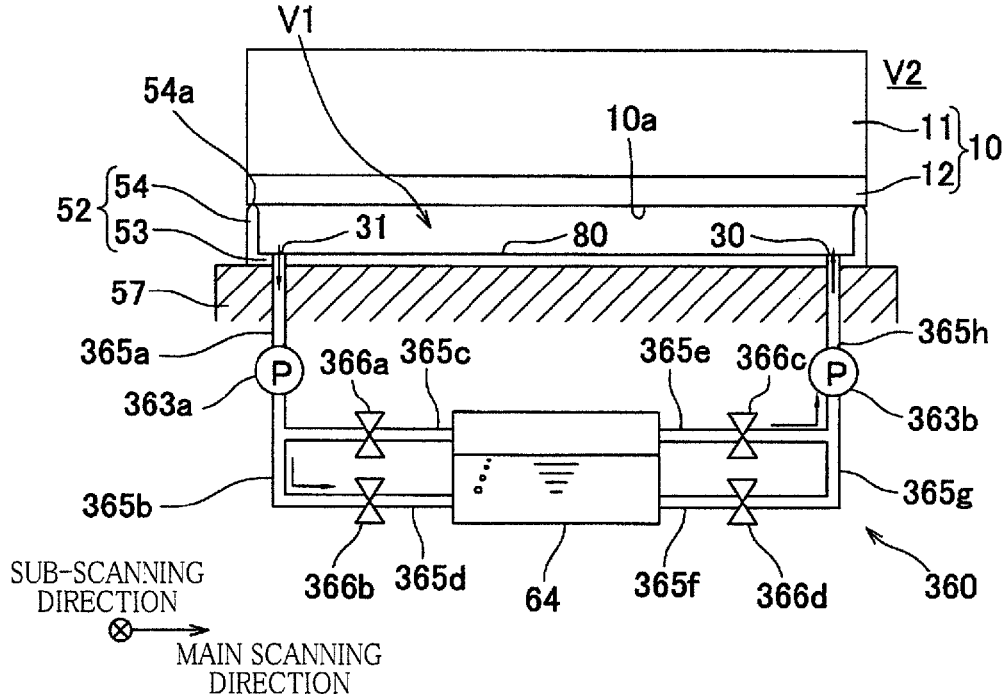
FIGS. 11A and 11B are schematic views each showing a humidification unit in a modification of the embodiment.
Figure 11B:
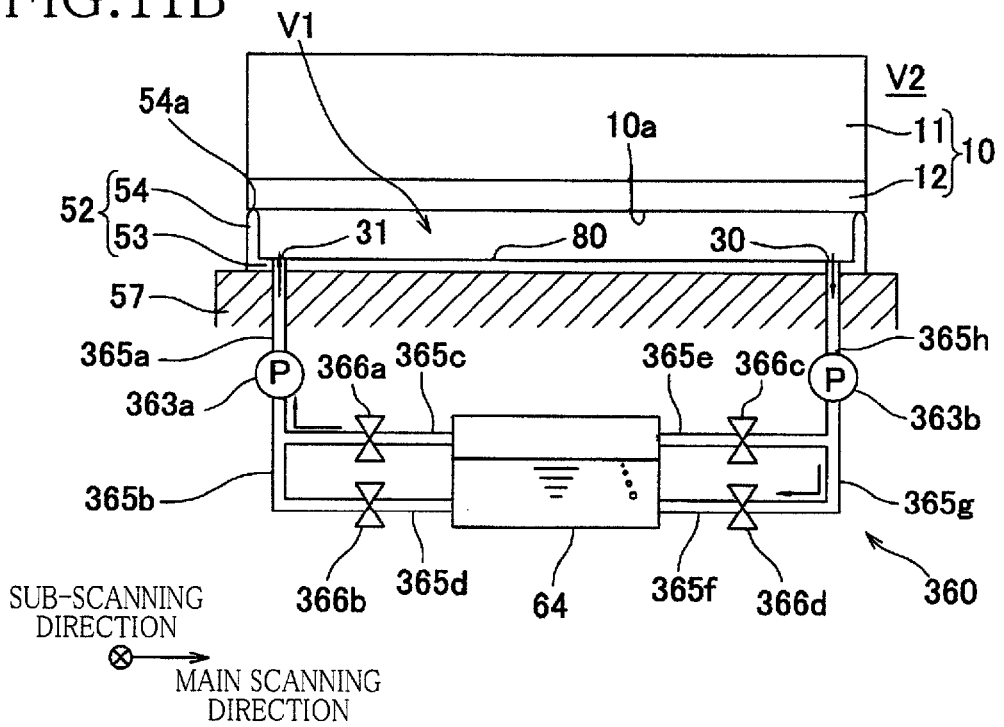

In this configuration, when the controller 100 drives the pump 363*a* in a state in which the opening and closing valves 366*a*, 366*d* are closed, and the opening and closing valves 366*b*, 366*c* are open, as shown in FIG. 11A, the air collected from the ejection space V1 through the opening 31 and the tubes 365*a*, 365*b*, 365*d* is humidified in the tank 64, and this humidified air (humid air) is then supplied into the ejection space V1 through the tubes 365*e*, 365*g*, 365*h* and the opening 30. On the other hand, when the controller 100 drives the pump 363*a* in a state in which the opening and closing valves 366*b*, 366*c* are closed, and the opening and closing valves 366*a*, 366*d* are open, as shown in FIG. 11B, the air collected from the ejection space V1 through the opening 30 and the tubes 365*h*, 365*g*, 365*f* is humidified in the tank 64, and this humidified air (humid air) is then supplied into the ejection space V1 through the tubes 365*c*, 365*b*, 365*a* and the opening 31. This modification can achieve the same effects as provided by the above-described embodiment. It is noted that, when being not driven, each of the pumps 363*a*, 363*b* functions as a channel connecting corresponding tubes.

Figure 12:
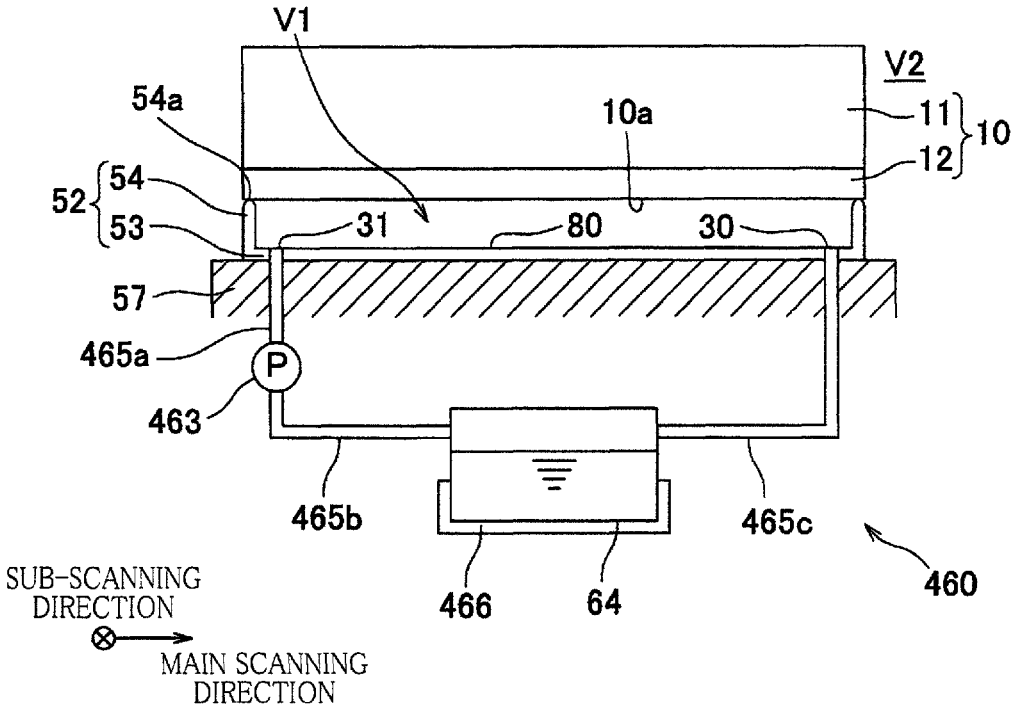
FIG. 12 is a schematic view showing a humidification unit in another modification of the embodiment.

As another modification, the humidification unit 60 in the above-described embodiment may be a humidification unit 460 shown in FIG. 12. This humidification unit 460 includes three tubes 465*a*-465*c*, a pump 463, the tank 64, and a heater 466. The tube 465*a* connects between the opening 31 and the pump 463. The tube 465*b* connects between the pump 463 and the tank 64. The tube 465*c* connects between the tank 64 and the opening 30. The tubes 465*b*, 465*c* are respectively connected to portions of the tank 64 above the water surface in the tank 64 so as to communicate with the upper space of the tank 64. The heater 466 is controlled by the controller 100 to heat a lower portion of the tank 64. As a result, the water in the tank 64 is heated, thereby generating humid air in the upper space. The pump 463 is rotatable forwardly and reversely.

When the heater 466 has been heated, and the pump 463 has been rotated forwardly by the control of the controller 100, the air collected from the ejection space V1 through the opening 31 and the tubes 465*a*, 465*b* is supplied into the tank 64, and the humid air in the upper space of the tank 64 is then supplied into the ejection space V1 through the tube 465*c* and the opening 30. On the other hand, when the heater 466 has been heated, and the pump 463 has been rotated reversely by the control of the controller 100, the air collected from the ejection space V1 through the opening 30 and the tube 465*c* is supplied into the tank 64, and the humid air in the upper space of the tank 64 is then supplied into the ejection space V1 through the tubes 465*b*, 465*a* and the opening 31. This modification can achieve the same effects as provided by the above-described embodiment.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, in the above-described embodiment, when the humid air is supplied into the ejection space V1 from one of the openings 30, 31, the air in the ejection space V1 is discharged from the other of the openings 30, 31, but only the supply of the humid air into the ejection space V1 may be performed from the openings 30, 31 alternately. In this configuration, the ejection face 10*a* is held in contact with the distal end 54*a* of the annular member 54 (or the peripheral portion 82 of the facing face 80 is held in contact with the distal end 501*a* of the projecting portion 501) such that the air in the ejection space V1 can be discharged to the outside space V2 when the pressure of the ejection space V1 in the sealing state is equal to or higher than the atmospheric pressure and just before the pressure of the ejection space V1 exceeds the meniscus withstanding pressure of the meniscuses of the ink in the ejection openings 14*a*.

Further, one or both of the first supply time and the second supply time may be a time for one supply operation. That is, in the above-described embodiment, two supply operations are performed from each of the openings 30, 31, but the humidifying maintenance processing may be performed such that one supply operation is performed from one of the openings 30, 31, and a plurality of the supply operations are performed from the other of the openings 30, 31. Alternatively, one supply operation may be performed from each of the openings 30, 31. That is, the controller 100 controls the humidification unit 60 in the current humid-air supply processing to supply the humid air into the ejection space V1 in the sealing state from both of the opening 30 and the opening 31, and the controller 100 controls the humidification unit 60 such that the period in which the humid air is supplied from the opening 30 and the period in which the humid air is supplied from the opening 31 do not overlap each other when the humid air is supplied into the ejection space V1 in the sealing state in the current humid-air supply processing. The period in which the humid air is supplied from the opening 30 and the period in which the humid air is supplied from the opening 31 do not need to be continuous to each other. Further, each of the first supply time and the second supply time may be a total or accumulative time of three or more supply operations.

The two openings 30, 31 do not need to be formed at the respective positions interposing all the ejection openings 14*a* therebetween in the main scanning direction. That is, the two openings 30, 31 only need to be formed at the respective positions interposing ones of the ejection openings 14*a* in the main scanning direction. Further, the two openings 30, 31 may be formed in the annular member 54.

Further, the rotor 58 may be omitted from the support-cap unit 50 in the above-described embodiment. For example, the printer 1 may be configured such that, when the mode change section 131 has changed the operation mode from the recording mode to the maintenance mode, the controller 100 controls the platen 51 to be moved downward, then the recessed member 52 having been waited is moved in the main scanning direction to a position between the platen 51 and the ejection face 10*a*, and then the distal end 54*a* of the annular member 54 of the recessed member 52 is brought into contact with the ejection face 10*a*.

The present invention is applicable not only to the monochrome printer but also to a color printer. The present invention is applicable to any of the line printer and a serial printer. Further, the application of the present invention is not limited to the printer, and the present invention is also applicable to devices such as a facsimile machine and a copying machine. Further, the present invention is also applicable to a device configured to eject liquid other than the ink. A plurality of the heads may be provided in the liquid ejection apparatus. The recording medium is not limited to the sheet P and may be various types of recordable media.

In the above-described embodiment, the single CPU executes all of the processings, but the present invention is not limited to this configuration. For example, a plurality of CPUs, an application-specific integrated circuit (ASIC), or a combination of the CPU and the ASIC may be used to execute the processings.

What is claimed is:

1. A liquid ejection apparatus, comprising:

a liquid ejection head having an ejection face that has a plurality of ejection openings through which the liquid ejection head ejects liquid, an ejection space being defined so as to face the ejection face;

a sealing mechanism configured to selectively establish (i) a sealing state in which the sealing mechanism seals the ejection space from an outside space and (ii) an unsealing state in which the sealing mechanism does not seal the ejection space from the outside space;

a first opening and a second opening formed respectively at positions interposing at least a part of the ejection face therebetween in one direction, the first opening and the second opening each being for supplying air into the ejection space therethrough;

a generating portion configured to generate humid air;

a supply portion configured to supply the humid air generated by the generating portion into the ejection space in the sealing state via one of the first opening and the second opening; and a controller configured to control the supply portion such that a first period in which the humid air is supplied via the first opening and is not supplied via the second opening, and a second period in which the humid air is not supplied via the first opening and is supplied via the second opening do not overlap each other in a current humid-air supply processing.

2. The liquid ejection apparatus according to claim 1, wherein the controller is configured to control the supply portion to supply the humid air into the ejection space via the first opening and the second opening alternately in the current humid-air supply processing.

3. The liquid ejection apparatus according to claim 1, wherein the controller is configured to control the supply portion in the current humid-air supply processing to supply the humid air from one of the first opening and the second opening, the one being used for a last supply of the humid air into the ejection space in a humid-air supply processing preceding the current humid-air supply processing.

4. The liquid ejection apparatus according to claim 1, wherein the supply portion is configured to return the humid air supplied into the ejection space, from the ejection space to the generating portion via one of the second opening and the first opening.

5. The liquid ejection apparatus according to claim 1, further comprising a third opening for discharging the air from the ejection space.

6. The liquid ejection apparatus according to claim 1, wherein the generating portion is disposed in the outside space.

7. A liquid ejection apparatus, comprising:

a liquid ejection head having an ejection face that has a plurality of ejection openings through which the liquid ejection head ejects liquid, an ejection space being defined so as to face the ejection face;

a sealing mechanism configured to selectively establish (i) a sealing state in which the sealing mechanism seals the ejection space from an outside space and (ii) an unsealing state in which the sealing mechanism does not seal the ejection space from the outside space;

a first opening and a second opening formed respectively at positions interposing at least a part of the ejection face therebetween in one direction, the first opening and the second opening each being for supplying air into the ejection space therethrough;

a generating portion configured to generate humid air;

a supply portion configured to supply the humid air generated by the generating portion into the ejection space in the sealing state via one of the first opening and the second opening; and a controller configured to control the supply portion such that a period in which the humid air is supplied via the first opening and a period in which the humid air is supplied via the second opening do not overlap each other in a current humid-air supply processing, wherein the plurality of ejection openings include (i) at least one first-opening-side ejection opening located on a side of a center of the ejection face in the one direction and nearer to the first opening than to the second opening in the one direction and (ii) at least one second-opening-side ejection opening located on a side of the center of the ejection face in the one direction and nearer to the second opening than to the first opening in the one direction, the center of the ejection face being interposed between the first opening and the second opening in the one direction, wherein the liquid ejection apparatus further comprising:

an ejection-history storage section storing a liquid ejection history pertaining to the ejection from the plurality of ejection openings onto a recording medium; and a judging section configured to judge which of the at least one first-opening-side ejection opening and the at least one second-opening-side ejection opening a greater amount of the liquid has been ejected from or a greater number of liquid ejections have been performed from, on the basis of a preceding liquid ejection history stored in the ejection-history storage section, the preceding liquid ejection history being a history pertaining to liquid ejection preceding current liquid ejection, wherein the controller is configured to control the supply portion in the current humid-air supply processing to supply the humid air from the second opening into the ejection space and then supply the humid air from the first opening into the ejection space where the judging section has judged that a greater amount of the liquid had been ejected from the at least one first-opening-side ejection opening or a greater number of liquid ejections had been performed from the at least one first-opening-side ejection opening, and wherein the controller is configured to control the supply portion in the current humid-air supply processing to supply the humid air from the first opening into the ejection space and then supply the humid air from the second opening into the ejection space where the judging section has judged that a greater amount of the liquid had been ejected from the at least one second-opening-side ejection opening or a greater number of liquid ejections had been performed from the at least one second-opening-side ejection opening.

8. The liquid ejection apparatus according to claim 7, wherein the controller is configured to control the supply portion in the current humid-air supply processing such that a second supply time for which the humid air is supplied from the second opening into the ejection space is greater than a first supply time for which the humid air is supplied from the first opening into the ejection space where the judging section has judged that a greater amount of the liquid had been ejected from the at least one first-opening-side ejection opening or a greater number of liquid ejections had been performed from the at least one first-opening-side ejection opening, and wherein the controller is configured to control the supply portion in the current humid-air supply processing such that the first supply time is greater than the second supply time where the judging section has judged that a greater amount of the liquid had been ejected from the at least one second-opening-side ejection opening or a greater number of liquid ejections had been performed from the at least one second-opening-side ejection opening.

9. A liquid ejection apparatus, comprising:

a liquid ejection head having an ejection face that has a plurality of ejection openings through which the liquid ejection head ejects liquid, an ejection space being defined so as to face the ejection face;

a sealing mechanism configured to selectively establish (i) a sealing state in which the sealing mechanism seals the ejection space from an outside space and (ii) an unsealing state in which the sealing mechanism does not seal the ejection space from the outside space;

a first opening and a second opening formed respectively at positions interposing at least a part of the ejection face therebetween in one direction, the first opening and the second opening each being for supplying air into the ejection space therethrough;

a generating portion configured to generate humid air;

a supply portion configured to supply the humid air generated by the generating portion into the ejection space in the sealing state via one of the first opening and the second opening; and a controller configured to control the supply portion such that a period in which the humid air is supplied via the first opening and a period in which the humid air is supplied via the second opening do not overlap each other in a current humid-air supply processing, wherein the controller is configured to control the supply portion in the current humid-air supply processing such that a first supply time for which the humid air is supplied from the first opening into the ejection space is equal to a second supply time for which the humid air is supplied from the second opening into the ejection space at a completion of the supply of the humid air into the ejection space.

10. The liquid ejection apparatus according to claim 9, further comprising:

a measuring portion configured to measure (i) a first execution time that is a length of time for which the humid air has been supplied from the first opening and (ii) a second execution time that is a length of time for which the humid air has been supplied from the second opening;

an execution-time storage section configured to store therein the first execution time and the second execution time measured by the measuring portion, wherein, when a liquid ejection signal for commanding the liquid ejection head to eject the liquid has been received in the current humid-air supply processing, the controller controls the supply portion in the current humid-air supply processing to cancel the supply of the humid air into the ejection space after controlling the supply portion in the current humid-air supply processing to supply the humid air into the ejection space from one of the first opening and the second opening which corresponds to a shorter one of the first execution time and the second execution time stored in the execution-time storage section, such that an execution time for one of the first opening and the second opening which corresponds to the shorter one of the first execution time and the second execution time becomes equal to a longer one of the first execution time and the second execution time.

11. A liquid ejection apparatus, comprising:

a liquid ejection head having an ejection face that has a plurality of ejection openings through which the liquid ejection head ejects liquid, an ejection space being defined so as to face the ejection face;

a sealing mechanism configured to selectively establish (i) a sealing state in which the sealing mechanism seals the ejection space from an outside space and (ii) an unsealing state in which the sealing mechanism does not seal the ejection space from the outside space;

a first opening and a second opening formed respectively at positions interposing at least a part of the ejection face therebetween in one direction, the first opening and the second opening each being for supplying air into the ejection space therethrough;

a generating portion configured to generate humid air;

a supply portion configured to supply the humid air generated by the generating portion into the ejection space in the sealing state via one of the first opening and the second opening; and a controller configured to control the supply portion such that a period in which the humid air is supplied via the first opening and a period in which the humid air is supplied via the second opening do not overlap each other in a current humid-air supply processing, wherein the controller is configured to control the supply portion to supply the humid air into the ejection space in the sealing state from one of the first opening and the second opening, when the controller has received one of a power-source OFF signal and a wait signal, and wherein the controller is configured to control the supply portion such that a period in which the humid air is supplied via the first opening and a period in which the humid air is supplied via the second opening do not overlap each other in the current humid-air supply processing, in situations other than a situation in which the controller has received one of the power-source OFF signal and the wait signal.

* * * * *